US010993541B2

(12) United States Patent
Garland

(10) Patent No.: US 10,993,541 B2
(45) Date of Patent: May 4, 2021

(54) CONVERTIBLE FURNITURE

(71) Applicant: American Leather Operations, LLC, Dallas, TX (US)

(72) Inventor: Thomas A. Garland, Bradenton, FL (US)

(73) Assignee: American Leather Operations, LLC, Dallas, TX (US)

( * ) Notice: Subject to any disclaimer, the term of this patent is extended or adjusted under 35 U.S.C. 154(b) by 226 days.

(21) Appl. No.: 16/002,011

(22) Filed: Jun. 7, 2018

(65) Prior Publication Data

US 2019/0110604 A1 Apr. 18, 2019

Related U.S. Application Data

(60) Provisional application No. 62/571,590, filed on Oct. 12, 2017.

(51) Int. Cl.
*A47C 17/16* (2006.01)
*A47C 17/86* (2006.01)
(Continued)

(52) U.S. Cl.
CPC ..... *A47C 17/163* (2013.01); *A47C 17/17* (2013.01); *A47C 17/2076* (2013.01); *A47C 17/86* (2013.01)

(58) Field of Classification Search
CPC ... A47C 17/163; A47C 17/17; A47C 17/2076; A47C 17/86; A47C 17/04; A47C 17/162;
(Continued)

(56) References Cited

U.S. PATENT DOCUMENTS 215,127 A * 5/1879 Jensen ..... A47C 7/62 297/188.11
1,809,812 A * 6/1931 Fox ..... A47C 17/22 5/22
(Continued)

FOREIGN PATENT DOCUMENTS

CA 953053 8/1974
CN 2043842 9/1989
(Continued)

OTHER PUBLICATIONS

Cover of HighPoints publication, Tiffany Sleeper, Market Introductions, Apr. 2000, 1 pg.
(Continued)

*Primary Examiner* — Nicholas F Polito
*Assistant Examiner* — Luke Hall
(74) *Attorney, Agent, or Firm* — Womble Bond Dickinson (US) LLP

(57) ABSTRACT

Furniture that is convertible between a seat position and a bed position is described. The furniture includes a first bed section with a first platform supporting a first cushion, and a second bed section with a second platform, a second cushion, and a partition disposed between the second platform and the second cushion. The first platform is configured to pivot relative to the second platform. The first cushion is thicker than the second cushion. When the furniture is in the bed position, a top surface of the first cushion is substantially coplanar with a top surface of the second cushion and the partition is spaced from the second platform by a first distance. In the seat position of the furniture, the distance between the partition and the second platform is less than the first distance.

21 Claims, 20 Drawing Sheets

(51) Int. Cl.
*A47C 17/17* (2006.01)
*A47C 17/207* (2006.01)

(58) Field of Classification Search
CPC .... A47C 17/1756; A47C 27/05; A47C 27/056
USPC ..... 5/17
See application file for complete search history.

(56) References Cited

U.S. PATENT DOCUMENTS

| | | | | | |
|---|---|---|---|---|---|
| 1,976,443 | A | * | 10/1934 | Foster | A47C 17/32 5/17 |
| 2,007,988 | A | | 7/1935 | Thomas, Jr. | |
| 2,560,018 | A | * | 7/1951 | Warner | A47C 27/062 5/248 |
| 2,570,401 | A | | 10/1951 | Stein | |
| 2,654,099 | A | * | 10/1953 | Ake | A47C 17/1756 5/47 |
| 2,664,145 | A | | 12/1953 | Creveling et al. | |
| 2,671,228 | A | | 3/1954 | De Maria | |
| 2,738,519 | A | * | 3/1956 | Thomas | A47C 17/23 5/12.1 |
| 2,740,131 | A | | 4/1956 | Vogel et al. | |
| 2,785,415 | A | | 3/1957 | Peterson | |
| 2,841,800 | A | | 7/1958 | Thomas | |
| 2,876,461 | A | | 3/1959 | Bontempi | |
| 3,058,778 | A | * | 10/1962 | Campbell | A47C 3/0252 297/452.5 |
| 3,085,257 | A | | 4/1963 | Laemmle | |
| 3,104,913 | A | | 9/1963 | Faulkner et al. | |
| 3,107,363 | A | | 10/1963 | Simmons | |
| 3,145,049 | A | | 8/1964 | Duke | |
| 3,178,731 | A | | 4/1965 | Pokorny, Jr. | |
| 3,179,469 | A | | 4/1965 | Heuston | |
| 3,319,269 | A | | 5/1967 | Maddox | |
| 3,456,268 | A | | 7/1969 | Rogers, Jr. | |
| 3,506,984 | A | | 4/1970 | Ellis, Jr. et al. | |
| 3,508,283 | A | | 4/1970 | Dukellis et al. | |
| 3,589,770 | A | | 6/1971 | Kelley | |
| 3,608,959 | A | | 9/1971 | Serves | |
| 3,695,690 | A | | 10/1972 | Carson | |
| 3,771,178 | A | | 11/1973 | Inman | |
| 3,844,612 | A | | 10/1974 | Borggren et al. | |
| 3,864,764 | A | | 2/1975 | Janusc | |
| 3,908,210 | A | | 9/1975 | Alembik | |
| 4,032,999 | A | | 7/1977 | Pringle | |
| 4,563,037 | A | | 1/1986 | Tiffany | |
| 4,694,514 | A | | 9/1987 | Crossett | |
| 4,737,996 | A | | 4/1988 | Tiffany | |
| 4,756,034 | A | * | 7/1988 | Stewart | A47C 17/1753 5/37.1 |
| 5,195,194 | A | * | 3/1993 | Bradley | A47C 17/161 5/37.1 |
| D338,349 | S | | 8/1993 | Warnock | |
| 5,320,407 | A | | 6/1994 | Tell | |
| D360,311 | S | | 7/1995 | Stamberg et al. | |
| D367,566 | S | | 3/1996 | Walters, III et al. | |
| 5,626,388 | A | | 5/1997 | Haltner | |
| 5,681,090 | A | | 10/1997 | St. Thomas | |
| 5,826,939 | A | | 10/1998 | Beyer | |
| 5,855,030 | A | | 1/1999 | Williams | |
| 5,904,401 | A | | 5/1999 | Alberda et al. | |
| 6,089,657 | A | | 7/2000 | Benno et al. | |
| 6,116,685 | A | | 9/2000 | White et al. | |
| 6,293,624 | B1 | | 9/2001 | Gaylord et al. | |
| 6,709,054 | B2 | | 3/2004 | Riley et al. | |
| 6,796,609 | B2 | | 9/2004 | Illulian | |
| D501,331 | S | | 2/2005 | Chen | |
| 6,904,628 | B2 | | 6/2005 | Murphy et al. | |
| 7,040,700 | B2 | | 5/2006 | Duncan et al. | |
| D526,803 | S | | 8/2006 | Lee | |
| 7,367,625 | B2 | | 5/2008 | Mori et al. | |
| 7,373,675 | B2 | | 5/2008 | Thurow | |
| 7,549,182 | B2 | | 6/2009 | Murphy | |
| 8,011,034 | B2 | | 9/2011 | Hoffman et al. | |
| 8,893,323 | B2 | | 11/2014 | Garland | |
| 8,997,273 | B2 | | 4/2015 | Murphy et al. | |
| 9,144,319 | B2 | | 9/2015 | Murphy et al. | |
| 9,314,104 | B2 | | 4/2016 | Stieglitc | |
| 9,468,303 | B2 | | 10/2016 | Garland | |
| 9,980,572 | B2 | | 5/2018 | Thurow | |
| 2003/0070225 | A1 | | 4/2003 | Murphy et al. | |
| 2007/0283491 | A1 | | 12/2007 | Murphy | |
| 2009/0235452 | A1 | | 9/2009 | Hoffman et al. | |
| 2010/0132116 | A1 | * | 6/2010 | Stacy | A61G 7/018 5/423 |
| 2011/0010846 | A1 | | 1/2011 | Murphy | |
| 2011/0010847 | A1 | | 1/2011 | Murphy | |
| 2011/0018331 | A1 | | 1/2011 | Murphy et al. | |
| 2014/0101846 | A1 | * | 4/2014 | Garland | A47C 17/132 5/55.1 |
| 2016/0262546 | A1 | | 9/2016 | Cassaday | |

FOREIGN PATENT DOCUMENTS

| | | |
|---|---|---|
| CN | 2060312 | 8/1990 |
| CN | 2222467 | 3/1996 |
| CN | 1271554 | 11/2000 |
| CN | 1583517 | 2/2005 |
| CN | 2860221 | 1/2007 |
| CN | 104754991 | 7/2015 |
| DE | 3513076 | 10/1986 |
| EP | 645108 | 3/1995 |
| GB | 2150021 | 6/1985 |
| JP | 5091464 | 7/1975 |
| WO | 1990015556 | 12/1990 |
| WO | 2013059309 | 4/2013 |

OTHER PUBLICATIONS

Cover of the Philadelphia Inquirer, Home and Design Section, Apr. 21, 2000, 1 pg.
Functional Upholstery Takes Center Stage, Furniture Today, vol. 24, No. 30d, Apr. 9, 2000, 2 pgs.
Home & Garden, Sun-Sentinel, p. 3E, South Florida, Apr. 14, 2000, 1 pg.
International Search Report and Written Opinion for PCT/US2013/64581, dated Mar. 25, 2014, 22 pgs.
Photograph 1, Version 1, sofa shown at trade show in San Francisco, folding center leg and Version 1 front leg actuator, Jan. 2000, 1 pg.
Photograph 10, Versions 1 and 2, inside arm sprint assist, Jan. 2000, 1 pg.
Photograph 11, Versions 1 and 2, inside arm spring assist, Jan. 2000, 1 pg.
Photograph 12, Versions 1 and 2, inside arm spring assist, Jan. 2000, 1 pg.
Photograph 2, Version 1, sofa shown at trade show in San Francisco, sofa partially opened, Jan. 2000, 1 pg.
Photograph 3, Version 1, sofa shown at trade show in San Francisco, sofa completely opened, Jan. 2000, 1 pg.
Photograph 4, Version 1, sofa shown at trade show in San Francisco, tube assembly front pivot offset and extended and folding center leg extended, Jan. 2000, 1 pg.
Photograph 5, Version 1, sofa shown at trade show in San Francisco, folding center leg extended and front wood leg with Version 1 of front leg actuator, Jan. 2000, 1 pg.
Photograph 6, Version 2, sofa shown at trade show in High Point, folding center leg extended and metal tube front leg with Version 2 of front leg actuator, Apr. 2000, 1 pg.
Photograph 7, Version 2, sofa shown at trade show in High Point, metal tube front leg with Version 2 of front leg actuator and folding center leg extended, Apr. 2000, 1 pg.
Photograph 8, Version 2, sofa shown at trade show in High Point, metal tube front leg with Version 2 of front leg actuator and folding center leg extended, Apr. 2000, 1 pg.
Photograph 9, Versions 1 and 2, tube assembly front pivot (offset & extended), Jan. 2000, 1 pg.
UDM Design News, p. 32, Jun. 2000, 1 pg.

(56) References Cited

OTHER PUBLICATIONS

International Search Report and Written Opinion of PCT/US12/60602, dated Jan. 4, 2013, 19 pgs.
Chinese Office Action for App. No. 201380056381.9, dated Dec. 22, 2016, 21 pgs.
Chinese Office Action for App. No. 20181187990.9, dated Nov. 16, 2020, 14 pgs.

* cited by examiner

CONVERTIBLE FURNITURE

TECHNICAL FIELD

The present invention relates to furniture, and more particularly to furniture that is convertible between a seat configuration and a bed configuration, such as a sofa bed.

BACKGROUND

Customers have long appreciated the functionality of furniture that converts between a seat configuration and a bed configuration. Individuals often purchase convertible furniture to provide additional sleeping arrangements for overnight guests, while the furniture is also able to provide suitable seating during the day. In some instances, where space is at a premium, convertible furniture, such as a sofa bed, may provide the primary sleeping arrangement for residents of loft or efficiency apartments. Similarly, the hospitality industry uses sofa beds in select hotel rooms to provide sleeping arrangements for additional persons, when needed, while being capable of providing seating when the permanent beds are otherwise sufficient to sleep the required number of guests in the room.

Traditionally, convertible furniture has suffered from two longstanding concerns, namely, limited bed comfort and limited seat comfort. First, when in a bed configuration, typical convertible furniture is often much less comfortable than a traditional mattress and box spring combination. The reduced comfort provided by traditional sofa beds can be caused by using spring mattresses that are much thinner than typical permanent mattresses. These thin mattresses are often required to provide the necessary pliability of the mattress to fold the mattress into the seat configuration of the furniture. The use of thin spring mattresses and underlying support structure exacerbates the discomfort problem by transmitting more of the pressure points caused by the traditional wire grid or tensioned trampoline support bars upon which these mattresses typically rest.

The inventors of the embodiments of the present disclosure have previously made significant strides in providing a more comfortable sofa bed. For example, U.S. Pat. No. 9,468,303, which is incorporated herein in its entirety, describes a sofa bed with a bed created from two or more bed sections that are able to fold relative to one another. The bed sections use memory foam or similar cushioning material, provided in 4 or 5" thick blocks, to provide an enhanced level of comfort compared to 3" foam mattresses or compressible spring mattresses. Further, each section of cushioning material is supported by a rigid panel, minimizing any transmission of pressure points from bars, wires, or springs through the cushion.

While the applicant's existing convertible furniture has made significant strides in bed comfort compared to traditional sofa beds, the space occupied by the bed sections 112, 114 in the seat position impact the ability to reach a desired seat height of 18" or 19" above the floor for seat comfort. Therefore, there continues to be further opportunity to improve the mechanisms used in convertible furniture to provide further packaging efficiencies while maintaining the new level of comfort expected from sofa beds such as those described in U.S. Pat. No. 9,468,303.

SUMMARY

One embodiment of the present disclosure includes furniture that is convertible between a seat position and a bed position. The furniture comprises a first bed section comprising a first platform supporting a first cushion, and a second bed section comprising a second platform, a second cushion, and a partition disposed between the second platform and the second cushion. The first platform is configured to pivot relative to the second platform. The first cushion has a first thickness measured perpendicular to the first platform, the second cushion has a second thickness measured perpendicular to the second platform, and the first thickness is greater than the second thickness. When the furniture is in the bed position, a top surface of the first cushion is substantially coplanar with a top surface of the second cushion, and the partition is spaced from the second platform by a first distance. In the seat position of the furniture, the distance between the partition and the second platform is less than the first distance.

Another embodiment of the present disclosure includes furniture that is convertible between a seat position and a bed position. The furniture comprises a first bed section comprising a first platform supporting a first cushion, and a second bed section comprising a second platform, a second cushion, and a partition disposed between the second platform and the second cushion. The second bed section is configured to fold relative to the first bed section. The furniture also includes a third bed section comprising a third platform supporting a third cushion, the third bed section being movable relative to the first and second bed sections. The first cushion has a first thickness measured perpendicular to the first platform, the second cushion has a second thickness measured perpendicular to the second platform, and the first thickness is greater than the second thickness. When the furniture is in the bed position, a top surface of the first cushion is substantially coplanar with and adjacent to a top surface of the second cushion and a top surface of the third cushion is substantially coplanar with and adjacent to the top surface of the second cushion. In the bed position, the partition is spaced from the second platform by a first distance. In the seat position of the furniture, the distance between the partition and the second platform is less than the first distance.

Another embodiment of the present disclosure includes furniture that is convertible between a seat position and a bed position. The furniture comprises a first bed section comprising a first platform supporting a first cushion, and a second bed section comprising a second platform, a second cushion, and at least one spring supporting the second cushion. The first cushion has a first thickness measured perpendicular to the first platform, the second cushion has a second thickness measured perpendicular to the second platform, and the first thickness is greater than the second thickness. A firmness of the first bed section is substantially equivalent to a firmness of the second bed section.

The present disclosure also includes a bed section for convertible furniture, the bed section having a bed position and a seat position. The bed section comprises a partition, a cushion resting on the partition, and a platform parallel to and capable of being spaced from the partition. The partition linearly translates relative to the platform to adjust a distance therebetween, the distance being greater in the bed position than in the seat position.

Another embodiment of the present disclosure includes furniture that is convertible between a seat position and a bed position. The furniture comprises a first bed section comprising a first platform supporting a first cushion, and a second bed section comprising a second platform and a second cushion, the second bed section being pivotable relative to the first bed section. When the furniture is in the bed position, the first platform is substantially coplanar with the second platform, and a top surface of the first cushion is substantially coplanar with a top surface of the second cushion, such that each bed section has an apparent thickness (T) measured from the top surface of the respective cushion to a bottom surface of the respective platform. When the furniture is in the seat position, the first and second bed sections are stacked relative to one another within a space having a height that is less than two times the apparent thickness.

For clarity, the figures include several partial assemblies where structures have been partially cut away or omitted. One of ordinary skill in the art will appreciate where elements of the present disclosure are suitable or intended for use in identical or mirrored pairs, and that by having shown and/or described only one of the elements in the pair, the resulting paired structures are similarly understood.

DETAILED DESCRIPTION OF SPECIFIC EMBODIMENTS

FIGS. 1-4 represent a series of positions involved in converting the sofa bed described in U.S. Pat. No. 9,468,303 (the "'303 patent) from a bed position to a seat position. The "bed position" may also be referred to as the bed configuration, the deployed position or the deployed configuration. The seat position may also be referred to as the seat configuration, the folded position or the folded configuration. Some embodiments of the present disclosure are improvements to the mechanism disclosed in the '303 patent, and therefore features of the sofa bed disclosed in the '303 patent may form elements of select embodiments of the present disclosure.

Figure 1:
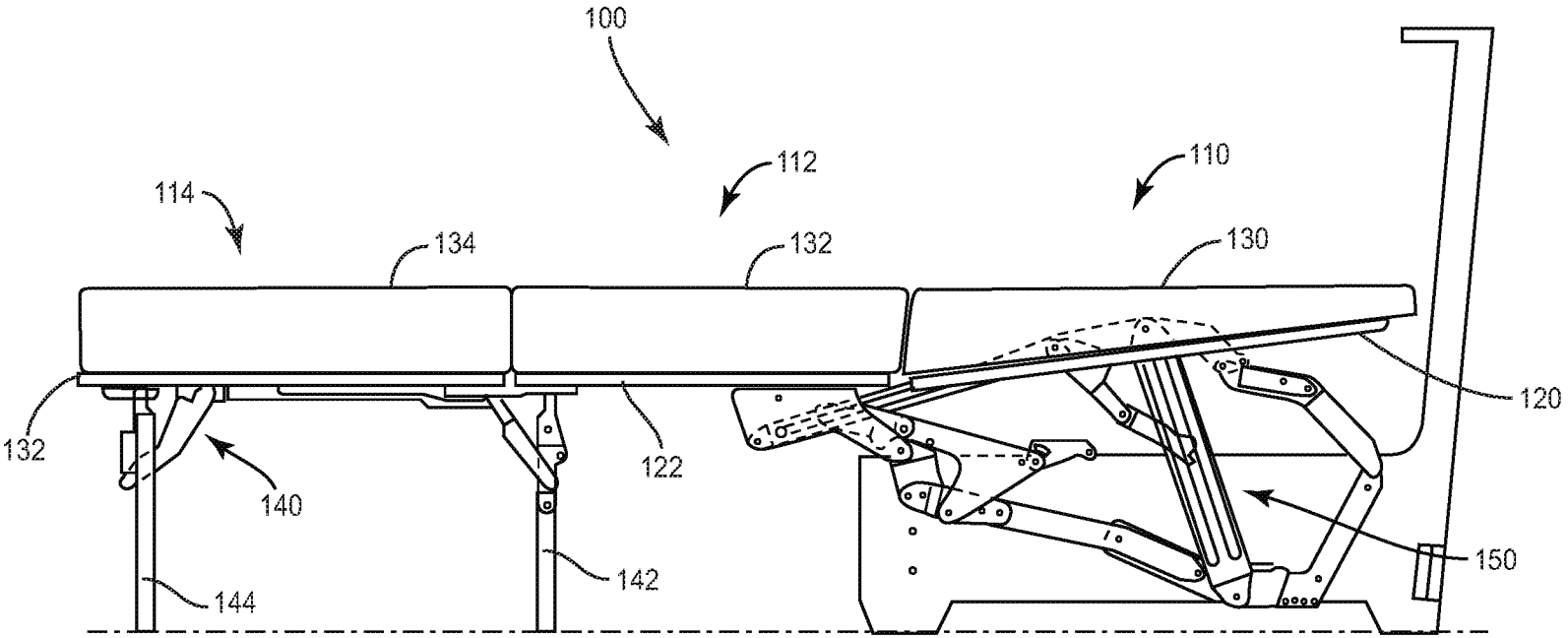
FIG. 1 (PRIOR ART)
FIG. 1 is a side view of a sofa bed in a bed configuration according to the prior art.
Figure 4:
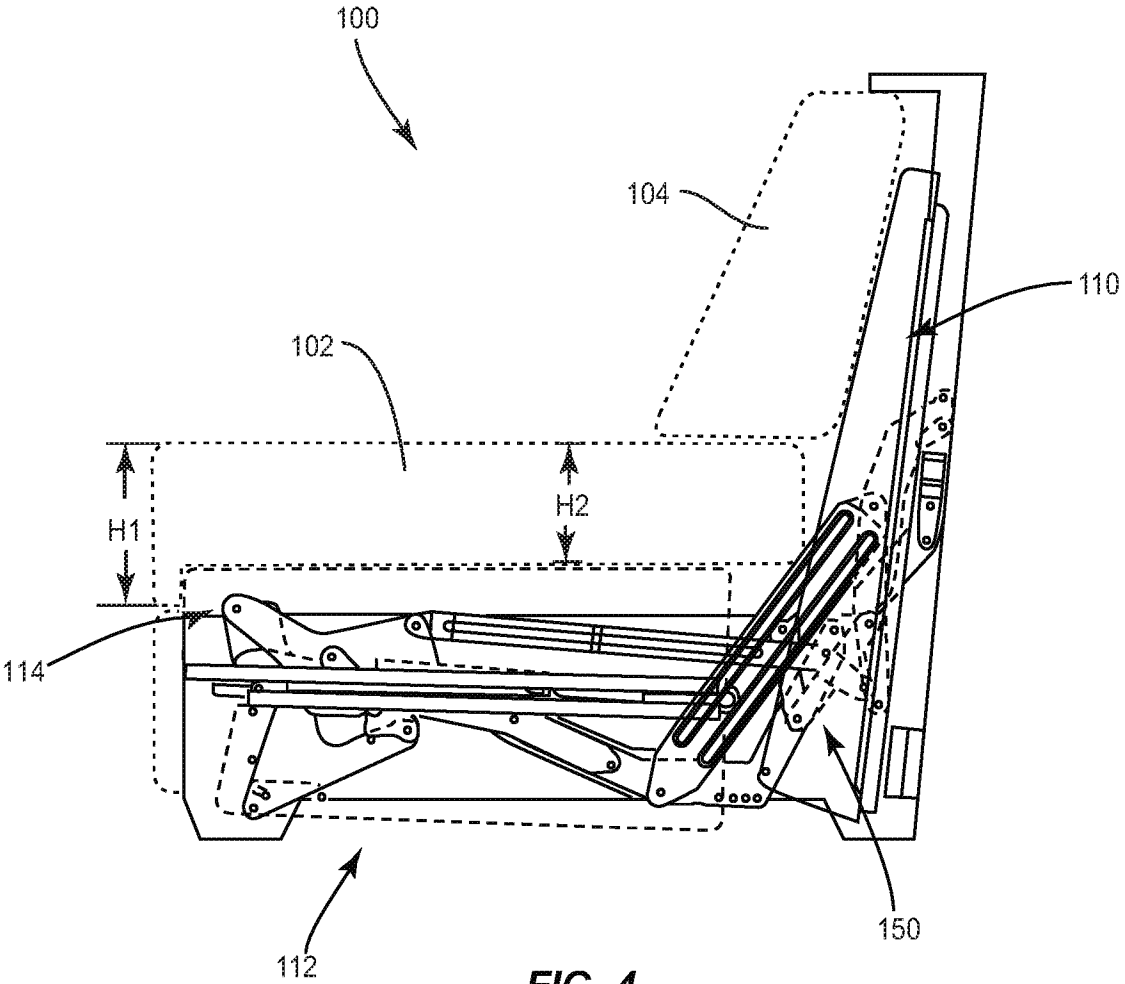
FIG. 4 (PRIOR ART)
FIG. 4 is a side view of a sofa bed in a seat configuration according to the prior art.

FIG. 1 shows a prior art sofa bed 100 in a bed position. Although described as a sofa bed, embodiments of the present disclosure apply more broadly to convertible furniture that are not limited to sofas, but may also include convertible chairs, or to an ottoman convertible to bed configurations. When in a seat position, such as shown in FIG. 4, the sofa bed may include a removable seat cushion 102 and a removable back cushion 104, both of which are shown in dashed lines. Providing for removable cushions 102, 104 in select embodiments increases the styling options of the sofa bed 100 but also takes up additional space when designers are attempting to reach a preferred seat height above the floor. As shown in FIG. 4, the removable seat cushion 102 may be used that gives a preferred frontal appearance of a 7" cushion (H1) by using a front section of increased thickness, while the remainder of the cushion may be 5" thick (H2) to keep the seat height down. Some users may prefer more than a 5" thick removable seat cushion. Irregular shaped removable seat cushions are also more costly to produce and cover than cushions of uniform thickness.

Figure 2:
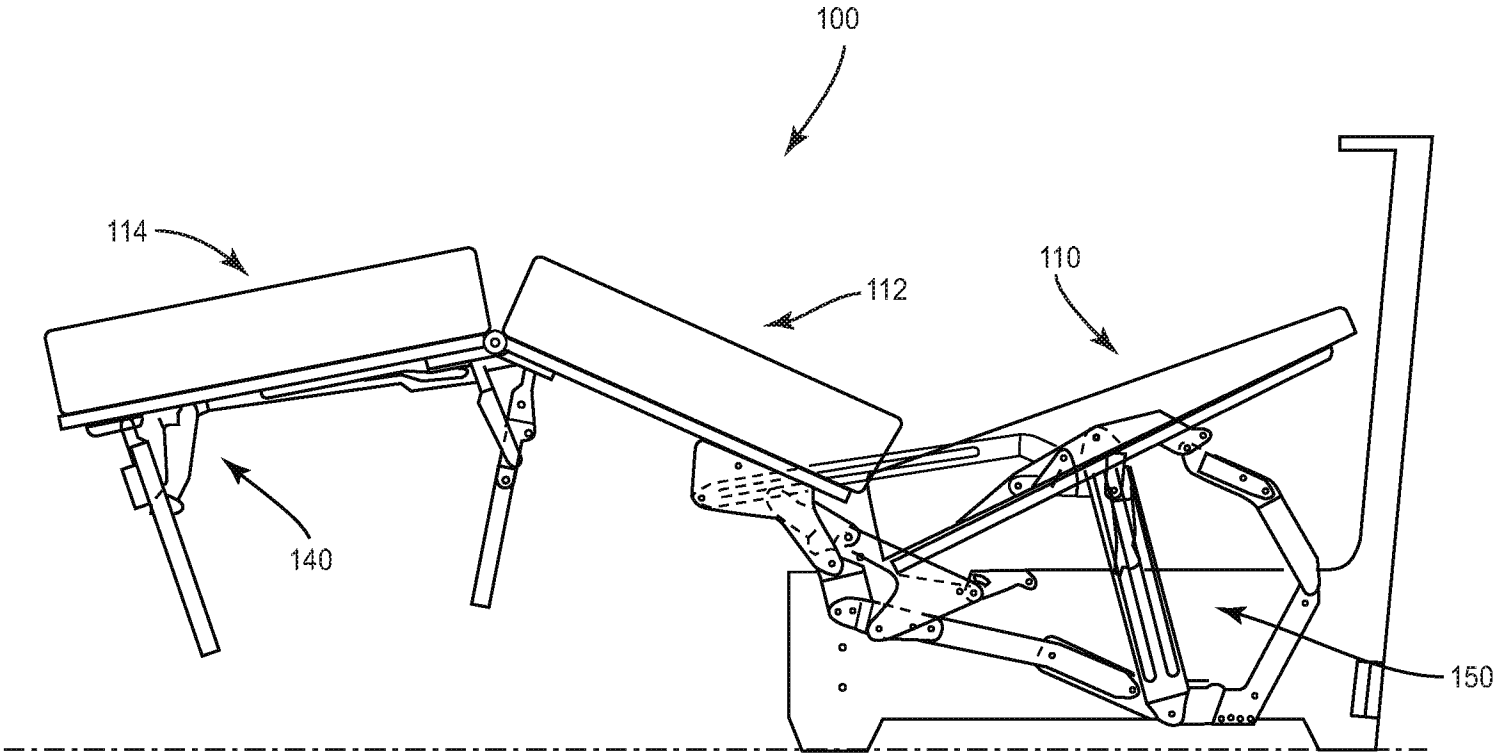
FIG. 2 (PRIOR ART)
FIG. 2 is a side view of a sofa bed in an initial, partially folded position according to the prior art.
Figure 3:
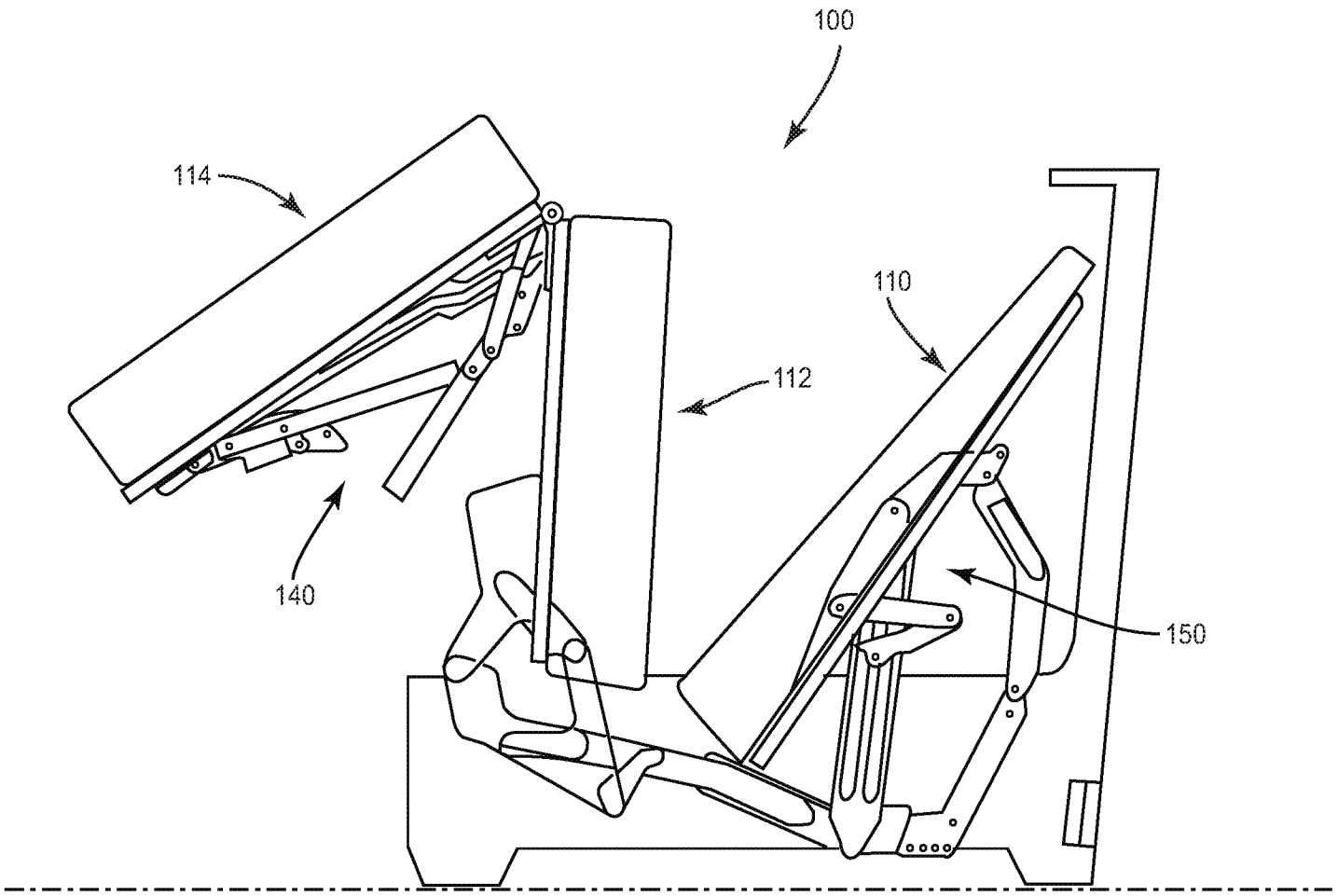
FIG. 3 (PRIOR ART)
FIG. 3 is a side view of a sofa bed in a subsequent, partially folded position according to the prior art.

Referring again generally to FIGS. 1-4, the prior art sofa bed 100 includes two or more bed sections. The illustrated sofa bed 100 includes a head bed section 110, a body bed section 112, and a foot bed section 114. The foot bed section 114 may be pivotally connected to the body bed section 112 via one or more torsional-hinge assemblies 116 (FIG. 2). The body bed section 112 may be connected to the head bed section 110 such that the movement of the body bed section is coordinated with the movement of the head bed section. Each bed section 110, 112, 114 may have a support panel 120, 122, 124 respectively, and a cushion 130, 132, 134, respectively, such that the cushions collectively form a mattress.

In the bed position, the bed sections 110, 112, 114 may be supported by one or more leg assemblies 140. The leg assemblies 140 may include a body bed section leg 142 and a foot bed section leg 144. Each of the legs 142, 144 is configured to fold relative to the foot support panel 124 for supporting the foot bed section 114 and the body bed section 112 above a floor in the bed position. The legs 142, 144 have a folded position substantially parallel with the foot support panel 124 in the seat position and an unfolded position substantially perpendicular to the foot support panel 124 in the bed position.

A folding apparatus 150 guides the movements of the head bed section 110 and the body bed section 112 between their bed position and their seat position.

The head bed section 110, in the deployed configuration (FIG. 1), is in a generally horizontal orientation with its cushion 130 facing up. In the folded configuration (FIG. 4), the head bed section 110 may be in a generally vertical orientation. In the illustrated embodiment, the folding apparatus 150 causes the cushion 130 of the head bed section 110 to face forward in the seat position. In other embodiments, however, the cushion 130 of the head bed section 110 may face backwards when the folding apparatus is folded.

The body bed section 112, in the deployed configuration (FIG. 1), is in a generally horizontal orientation with its cushion 132 facing up. In the folded configuration (FIG. 4), the body bed section 112 may be in the generally horizontal orientation with its cushion 132 being proximal to the floor and facing down. In other embodiments, the body bed section 112 may have its cushion 132 face upward in the seat position. In other embodiments, the body bed section 112 may not be proximal to the floor in the folded configuration.

The foot bed section 114, in the deployed configuration (FIG. 1), is in a generally horizontal orientation with its cushion 134 facing up, while in the folded configuration (FIG. 4), the foot bed section may be in the generally horizontal orientation and located above the body bed section 112 with its cushion 134 facing up. In other embodiments the cushion 134 of the foot bed section 114 may face down in the folded configuration of the sofa bed 100. In other embodiments the cushion 134 of the foot bed section 114 may be located below the body bed section 112 in the folded position.

The folding pattern of the sofa bed 100 of FIGS. 1-4, described in more detail in the '303 patent, provides only one of many possible baseline structures that can be improved with the embodiments of the present disclosure. In other embodiments, the structures, features and functions presented in this disclosure are applicable to convertible furniture employing significantly different conversion mechanisms. For example, embodiments according to the present disclosure are not necessarily limited to convertible furniture with three bed sections, but may be applicable to furniture with two bed sections or even four or more bed sections. Embodiments of the present disclosure may be applied to convertible furniture with seat positions with or without a substantially vertically positioned bed section. Embodiments of the present disclosure may provide for transition from the bed position to the seat position through simultaneous motion of the bed sections, sequential motion of the bed sections, linked motion of the bed sections, including the plurality of bed sections forming portions of a unitary structure, or independent motion of the bed sections. In various embodiments, the bed sections may rotate, pivot, hinge, fold, slide, translate or otherwise move relative to one another in various forms.

Turning to FIGS. 5-10, a sofa bed 200 is shown according to embodiments of the present disclosure that is convertible between a seat position and a bed position. The sofa bed 200 is not particularly limited to the size of the bed, which may include, but is not limited to, king, queen, full, twin, or cot sizes such that the sofa bed may be referred to more generally as a convertible chair, convertible seat, or convertible ottoman, collectively, "convertible furniture."

Figure 5:
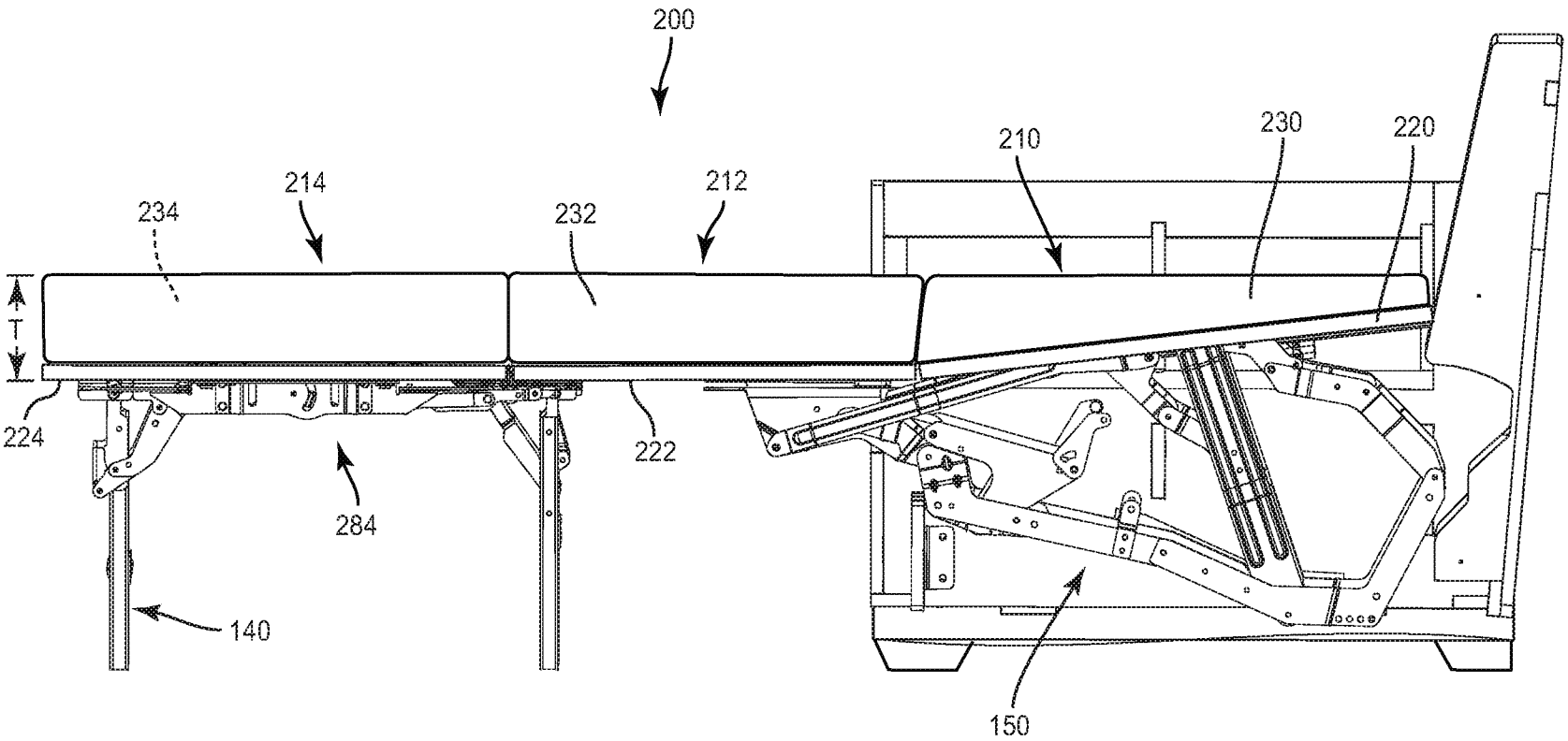
FIG. 5 is a side view of a convertible furniture according to an embodiment of the present disclosure in a bed position.

As shown in FIG. 5, the sofa bed 200 according to the present disclosure may include a body bed section 212, which may include a body platform 222 supporting a body cushion 232, which are substantially similar to the corresponding elements of the sofa bed 100 described with respect to FIGS. 1-4.

As shown in FIG. 5, the sofa bed 200 may also include a foot bed section 214 that may have a foot platform 224 and a foot cushion 234 such that the foot bed section 214 appears similar to the foot bed section 114 when the sofa bed is in the bed position. For example, the body platform 222 is substantially coplanar with the foot platform 224 while a top surface of the body cushion 232 is substantially coplanar with a top surface of the foot cushion 234 producing an apparent thickness T measured from the top surface of the respective cushion to a bottom surface of the respective platform. In one embodiment, T is approximately 5.75", about 0.75" of which is the platform. In one embodiment, the foot platform 224 is configured to pivot relative to the body platform 222.

Figure 6:
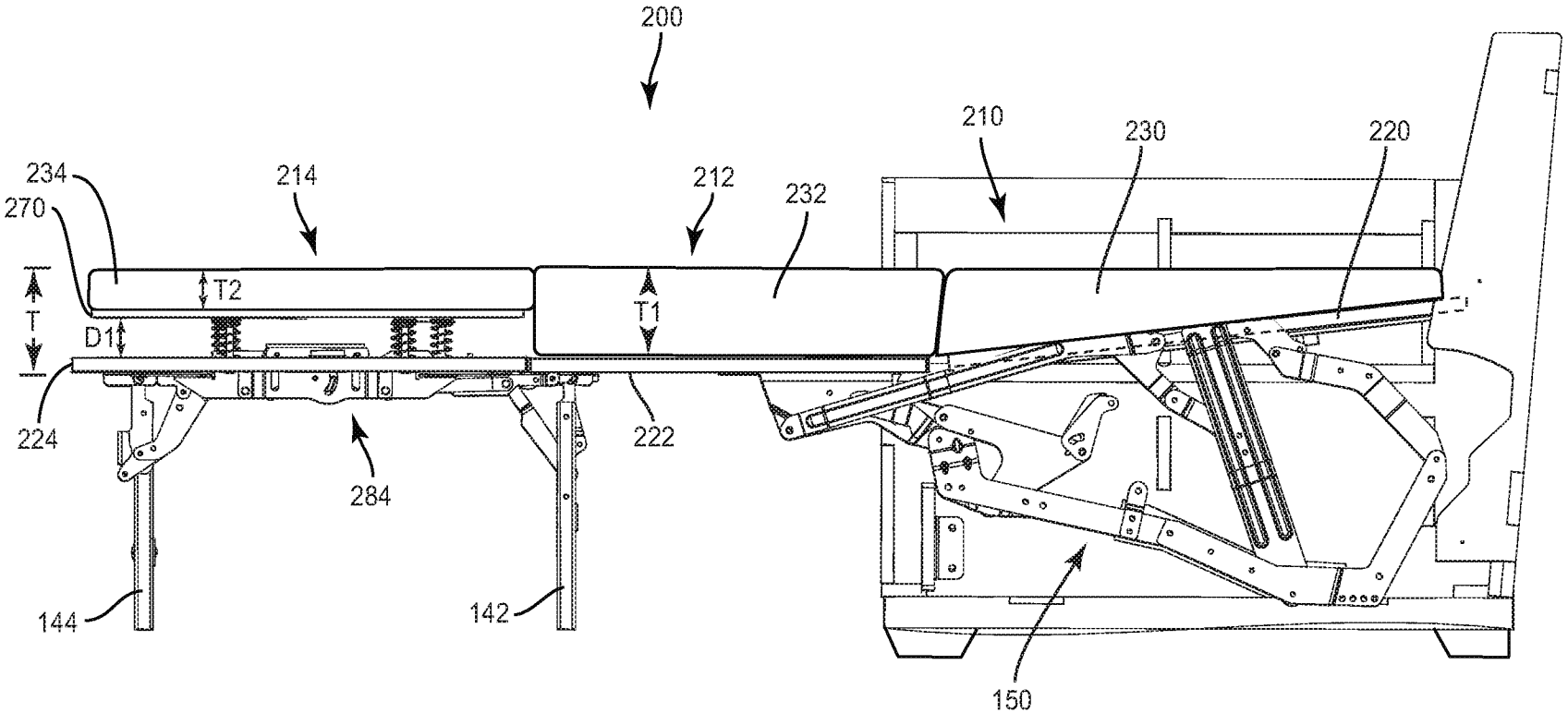
FIG. 6 is a side view of the furniture of FIG. 5 with ticking removed.

The illustrated embodiment of FIGS. 5 and 6 shows an optional head bed section 210 with a head platform 220 and a head cushion 230, where a top surface of the head cushion 230 is substantially coplanar with the top surface of the foot cushion 134 in the bed position. The head bed section 210 may be movable relative to the body and foot bed sections 212, 214 independently or in coordination with movement between the body and foot bed sections. In one embodiment, a folding apparatus 150 from the sofa bed 100 (as described above) is used with the sofa bed 200 to coordinate movement between the head bed section 210 and the body bed section 212.

A partition 270 is shown in FIG. 6 with the upholstery covering removed. The partition may be disposed between the foot platform 224 and the foot cushion 234. In one embodiment, the partition 270 is formed from wood and is approximately ⅜ inch thick. Depending upon the construction, the partition 270 may be a rigid moving platform or may be flexible under the weight of a user. The partition 270 is adjustable relative to the foot platform 224. As a result, the foot bed section 214 expands in the bed position and collapses in the seat position such that the thickness of the foot bed section in the seat position is less than the apparent thickness T (FIG. 5).

Figure 9:
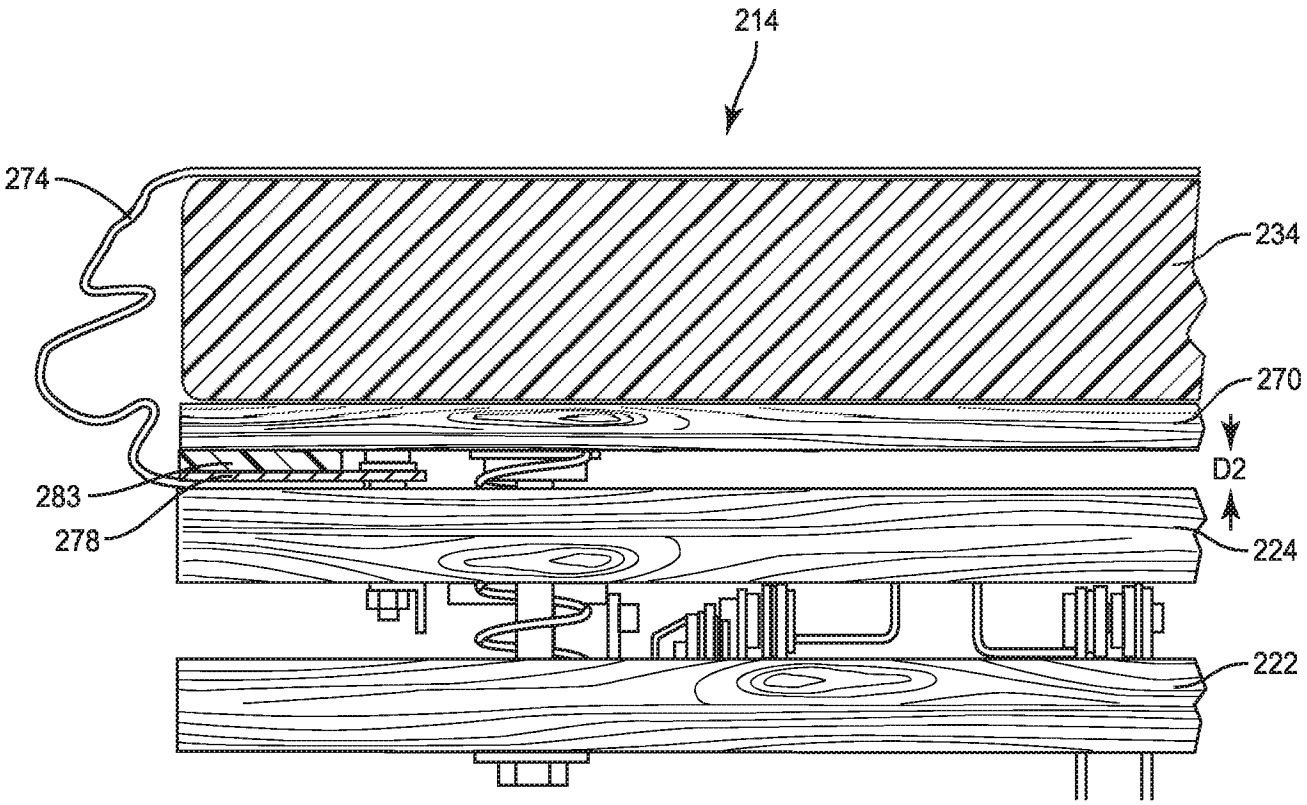
FIG. 9 is a detailed later cross section view of the foot bed section of the furniture of FIG. 5 in the seat position.
Figure 10:
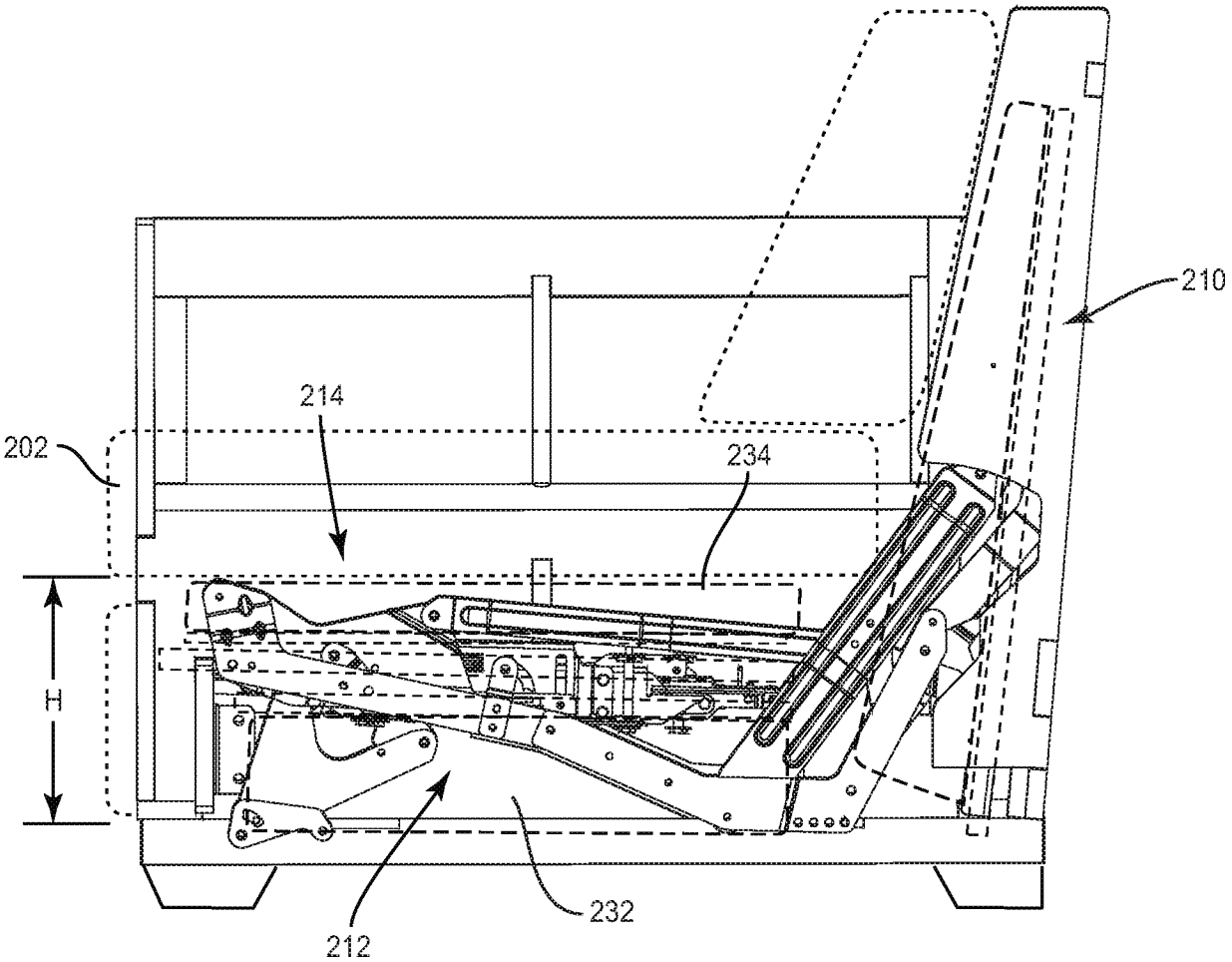
FIG. 10 is a side view of the furniture of FIG. 6 in a seat position.

As shown in FIG. 6, the body cushion 232 of the embodiment shown is thicker than the foot cushion 234. For example, body cushion 232 has a first thickness T1 measured perpendicular to the body platform 222 and the foot cushion 234 has a second thickness T2 measured perpendicular to the foot platform 224, and the first thickness is greater than the second thickness. When the sofa bed 200 is in the deployed configuration, the partition 270 is spaced from the foot platform 224 by a first distance D1 to properly position the top surface of the foot cushion 234 approximately coplanar with the thicker body cushion 232. As shown in FIG. 9, in the seat position of the sofa bed 200, the distance D2 between the partition 270 and the foot platform 224 is less than the first distance D1. As a result, when the foot bed section 214 and the body bed section 212 are stacked, in one embodiment of the seat position, as shown in FIG. 10, the height H of the stack from the downward facing top surface of the body cushion 232 to the upward facing top surface of the foot cushion 234 is less than two times the apparent thickness T (FIG. 5) of each bed section 212, 214 individually, measured when in the bed position. Because H (FIG. 10) is less than twice T, a removable seat cushion 202 with a uniform thickness of approximately 7" can be used while remaining at the preferred seat height.

Figure 7:
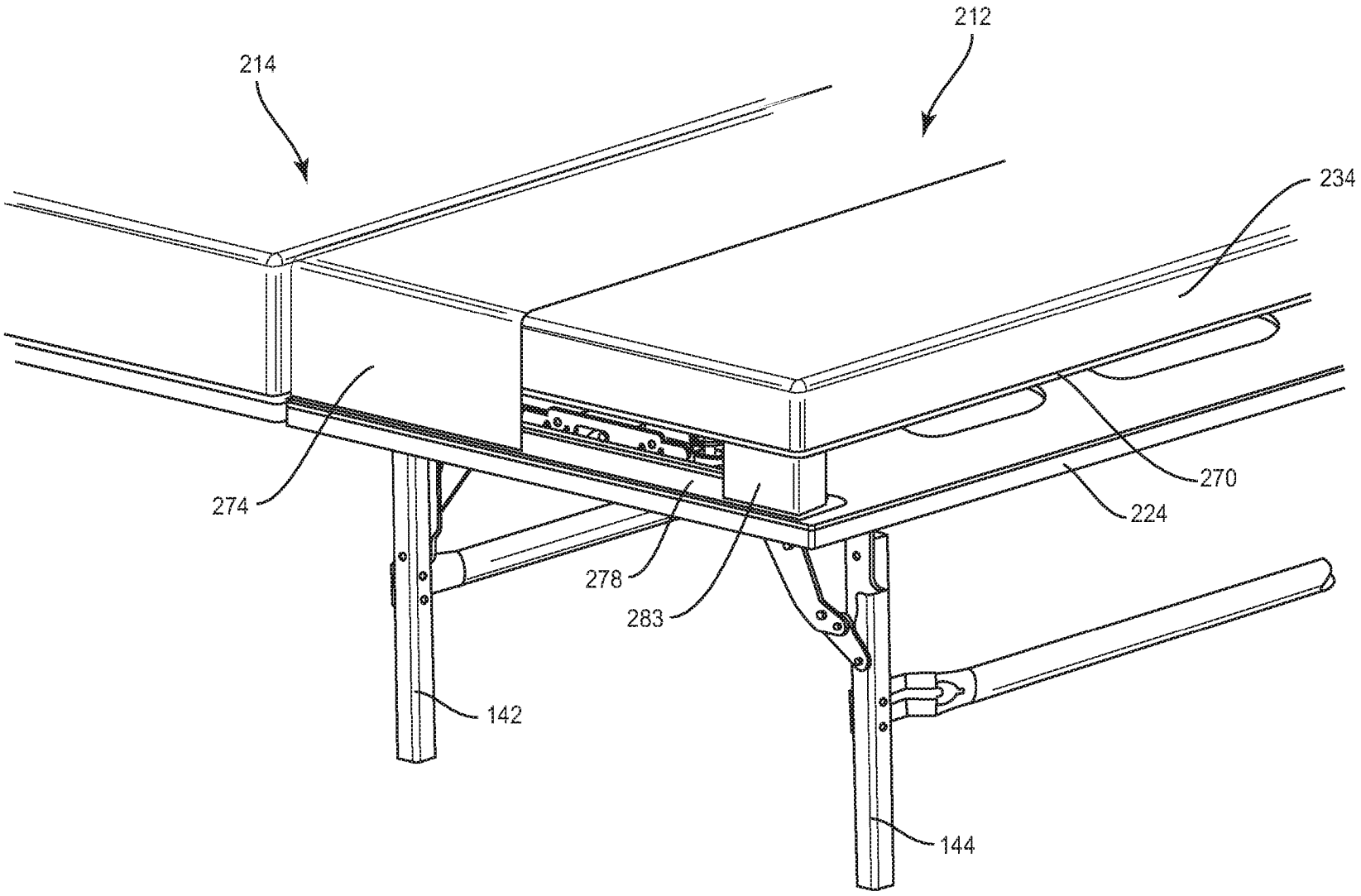
FIG. 7 is a detailed, partial cut-away view of a foot bed section of the furniture of FIG. 5.
Figure 8:
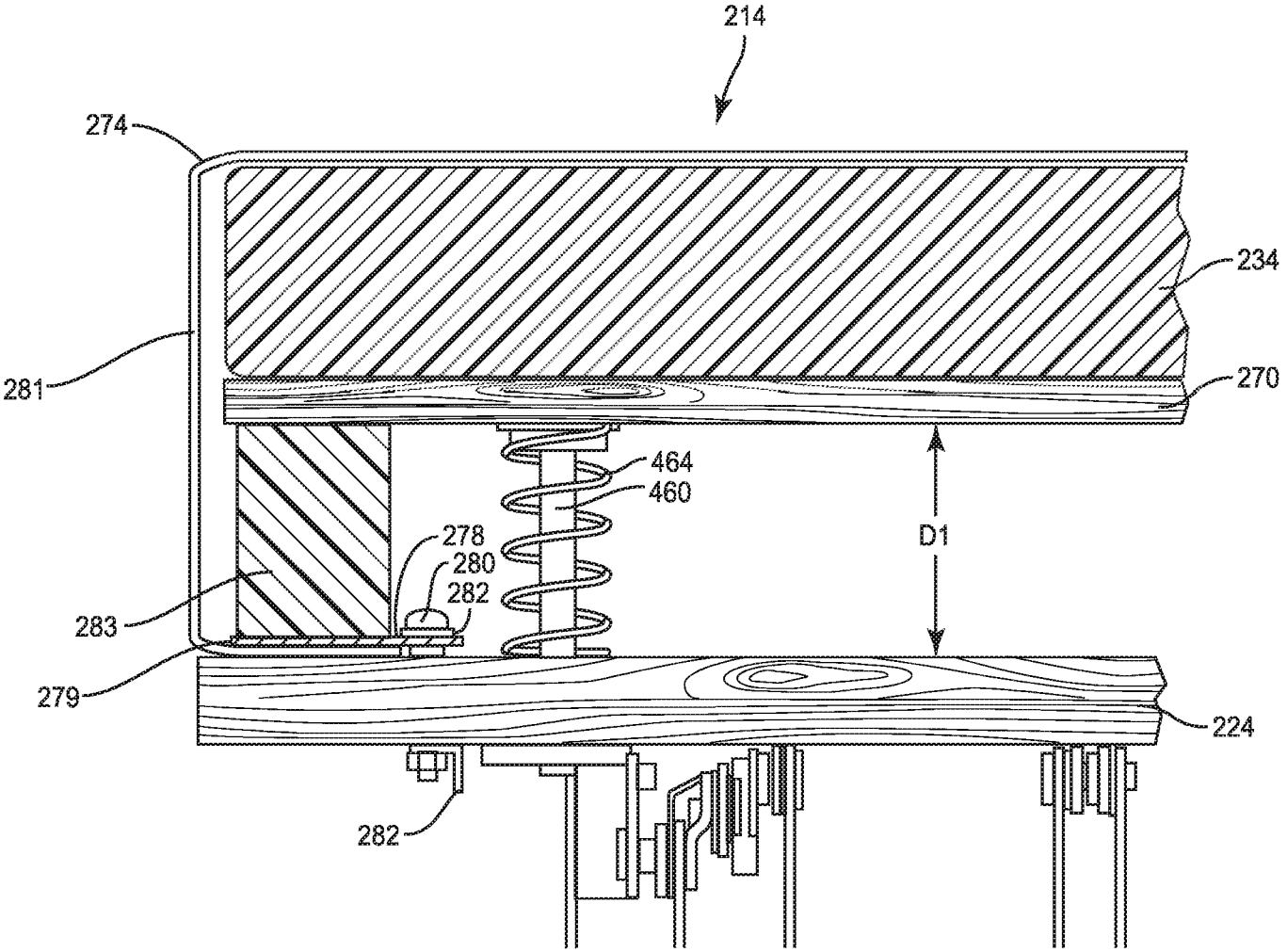
FIG. 8 is a detailed lateral cross sectional view of the foot bed section of the furniture of FIG. 5 in the bed position.

FIGS. 7-9 illustrate a construction of the foot bed section 214 that helps provide the appearance, in the bed position, that the foot cushion 234 is as thick as the body cushion 232. First, the foot cushion 234 is covered in ticking 274. The ticking 274 may be applied from the top surface of the foot platform 224 around the top surface of the foot cushion 234. The ticking may include a padding layer.

A tuck panel 278 may be used to position the ticking 274 relative to the top surface of the foot platform 224. An outer edge 279 of the tuck panel 278 can provide tension to the ticking 274 when the foot cushion 234 is in the bed position. The outer edge 279 will tend to pull downward and outward on the ticking 274 to create a taught peripheral surface portion 281 for the ticking 274. As a result of the tight peripheral surface portion 281, the foot bed section 214 looks and feels substantially similar to a construction with a cushion alone and no gap between a partition 270 and the foot platform 224. The optional padding on the interior of the ticking 274 may further obscure the ability to perceive the partition 270 visually or tactually from the side of the foot bed section 214. In one embodiment, the tuck panel 278 is a 1/32" polymer sheet that is rigid enough to hold the shape of the ticking 274 but is sufficiently flexible, when subject to external forces, to flex relative to the top surface of the foot platform 224 to accommodate the insertion of a portion of a bed sheet between the tuck panel 278 and the top surface of the foot platform. The tuck panel 278 may be a strip-shaped member positioned along each side edge of the foot platform 224. Therefore, although only one tuck panel 278 is illustrated in FIGS. 7-9, one skilled in the art will appreciate that a tuck panel could be provided at each opposite side of the foot platform 224 as well as a front edge of the foot platform when the foot platform is in the bed position.

As shown in FIG. 8, the tuck panel 278 may be attached to the foot platform 224 using bolts 280 or other attachment methods known in the art. Metal reinforcing strips 282 may sandwich the foot platform 224 and the tuck panel 278 where the bolts 280 are applied in order to distribute the load from the bolts and reinforce the foot platform.

To further hide the presence of a gap between the foot platform 224 and the partition 270 when viewed from the top and sides, compressible low-density foam pieces 283 may be positioned between the tuck panel 278 and the partition 270 along the sides thereof to substantially fill a gap therebetween. The foam pieces 283 may internally support the ticking 274 and minimize the ability to press into a lateral side surface portion of the ticking, thus helping the foot bed section 214 to look and feel, when viewed or pressed from the side in the bed position, like the body bed section 212. The foam pieces 283 along the edges of the foot platform 224 may be approximately 2" wide, intending primarily to support the ticking 274 and not to significantly support the partition 270. Additional foam pieces (not shown) may be optionally positioned between the top surface of the foot platform 224 and the partition 270 at one or more interior locations away from the edges of the foot platform. These additional foam pieces may assist to reduce noise associated with moving parts as the distance between the foot platform 224 and the partition 270 changes as a result of loading, or the result of converting the sofa bed 200 between the seat position and the bed position.

To emphasize again, the tuck panel 278 positions the ticking 274 and the ticking can be supported at the interior thereof by the foam pieces 283 to create a foot bed section 214 that is compressible in thickness for purposes of converting the sofa bed 200, but which is able to maintain the appearance from the top and sides in the bed position as if the foot bed section were constructed substantially similar to the body bed section 212. In addition to the aesthetic appearance, the foam pieces 283 contribute to the sides of the foot bed section 214 feeling much like the construction of the body bed section 212. Further, in one embodiment, the body cushion 232 is centrally attached to the body platform 222, providing the ability to pull up the edges of the body cushion 232 and insert a bed sheet between the body cushion and the body platform. The tuck panel 278 used in the foot bed section 214 provides similar functionality, allowing a bed sheet to be tucked between the ticking 274 and the foot platform 224. Here again, structures and functions have been included so that the perceived difference between the foot bed section 214 and the body bed section 212 is minimized when the sofa bed 200 is in the bed position.

Figure 17:
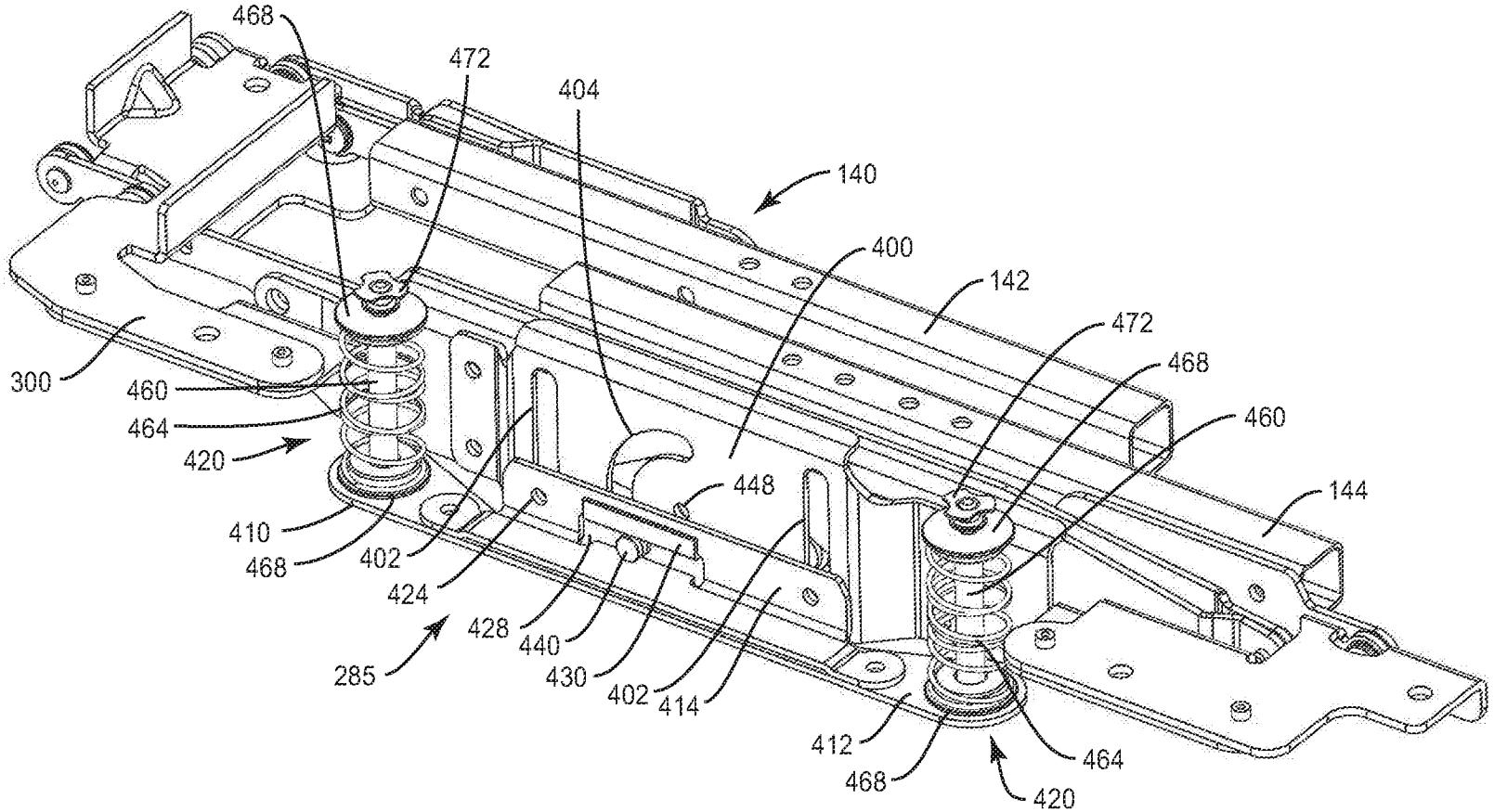
FIG. 17 is an exterior top perspective view of the first support assembly in the seat position.
Figure 18:
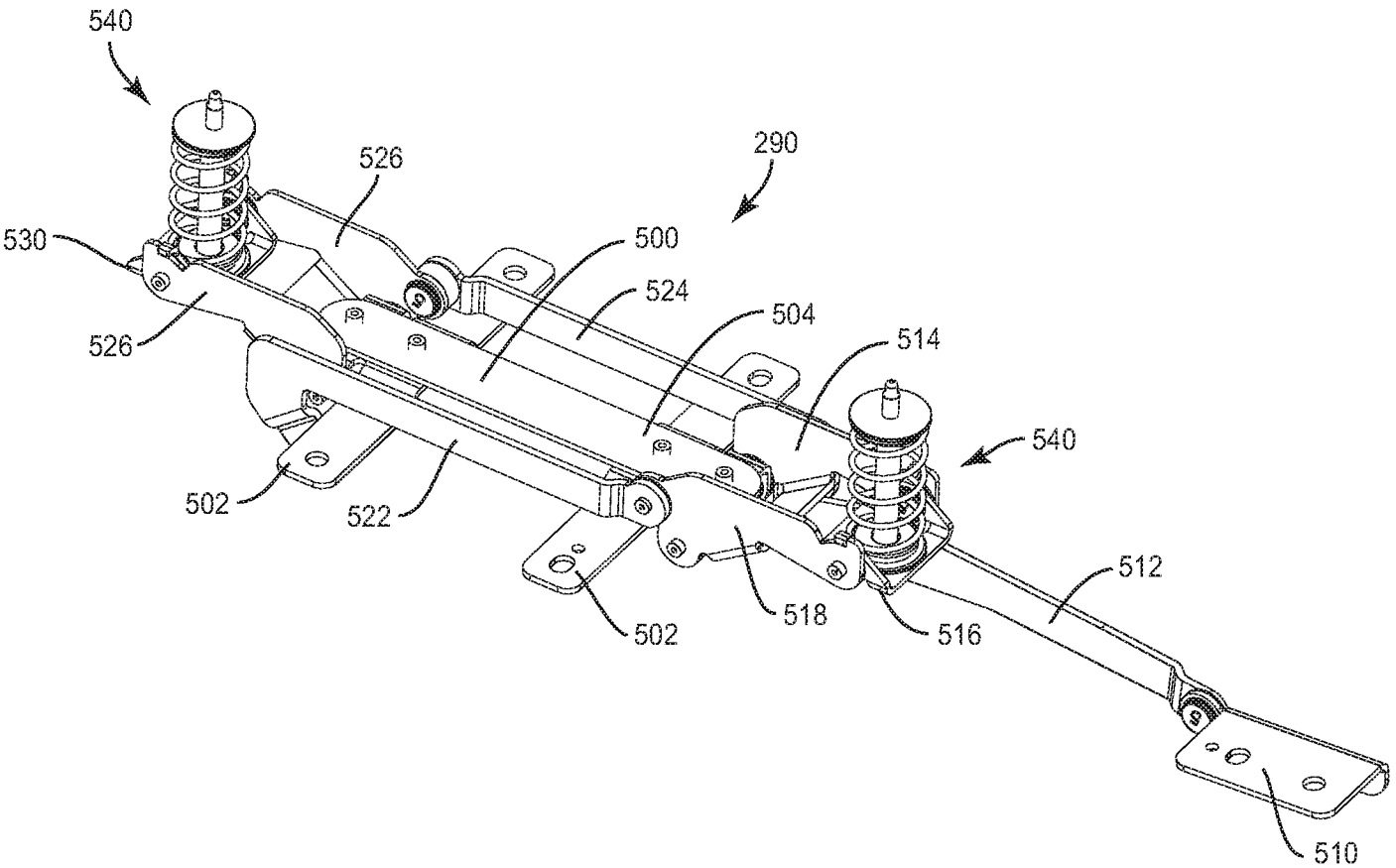
FIG. 18 is a top perspective view of a second support assembly in the bed position.
Figure 19:
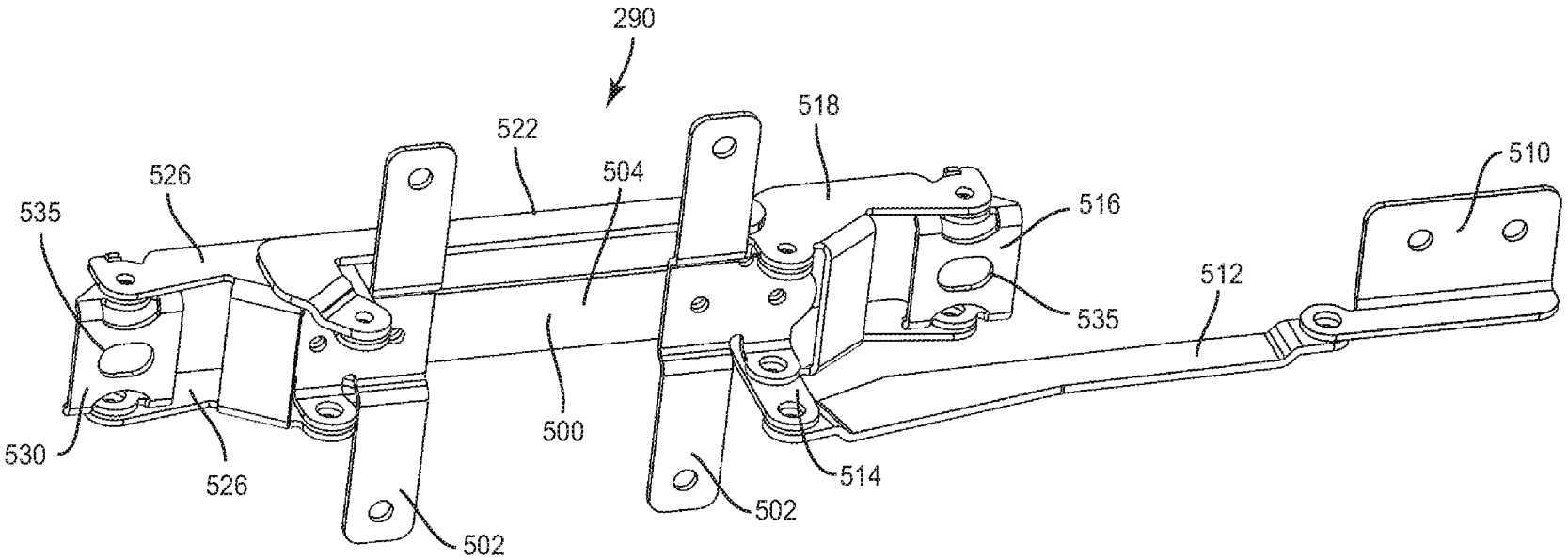
FIG. 19 is a partial bottom perspective view of the second support assembly in the bed position.
Figure 20:
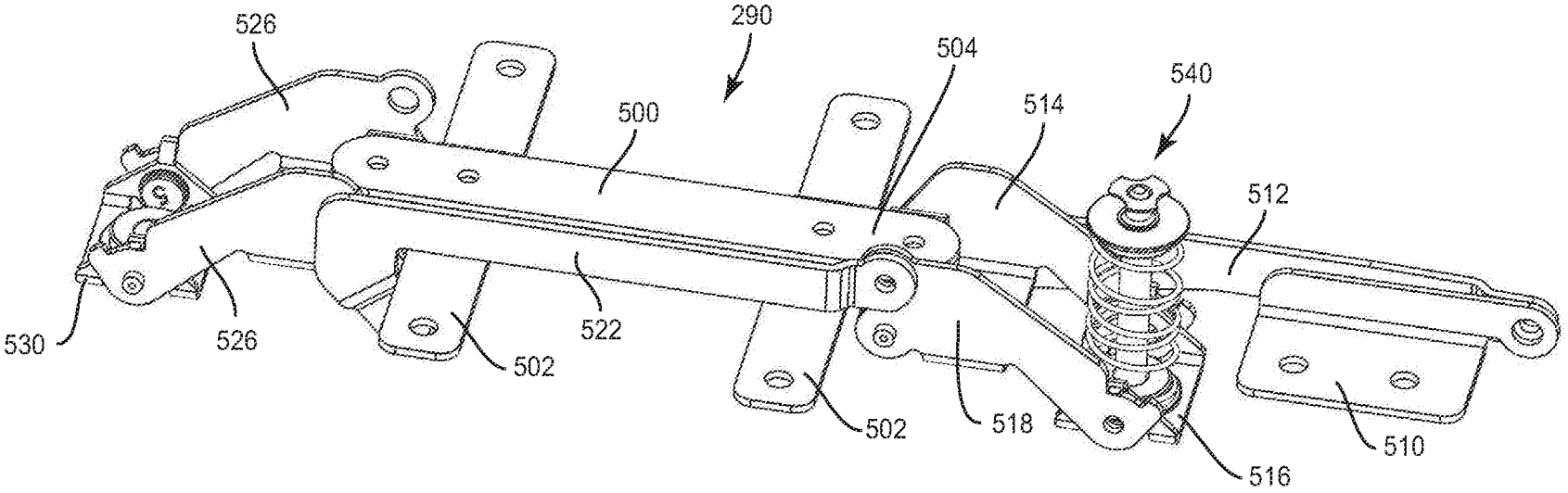
FIG. 20 is a partial top perspective view of the second support assembly in the seat position.

As shown in FIG. 6, and again in much more detail in FIGS. 11-20, movement of the partition 270 relative to the foot platform 224 may be facilitated by a support mechanism 284, that may include one or more first support assemblies 285 (FIGS. 11-17), and may optionally include one or more second support assemblies 290 (FIGS. 18-20). In keeping with the illustrated embodiment, the support mechanism 284 facilitates motion of the partition 270 relative to the foot platform 224 as a result of motion, particularly folding, of the foot bed section 214 relative to another of the bed sections, such as the body bed section 212.

Figure 11:
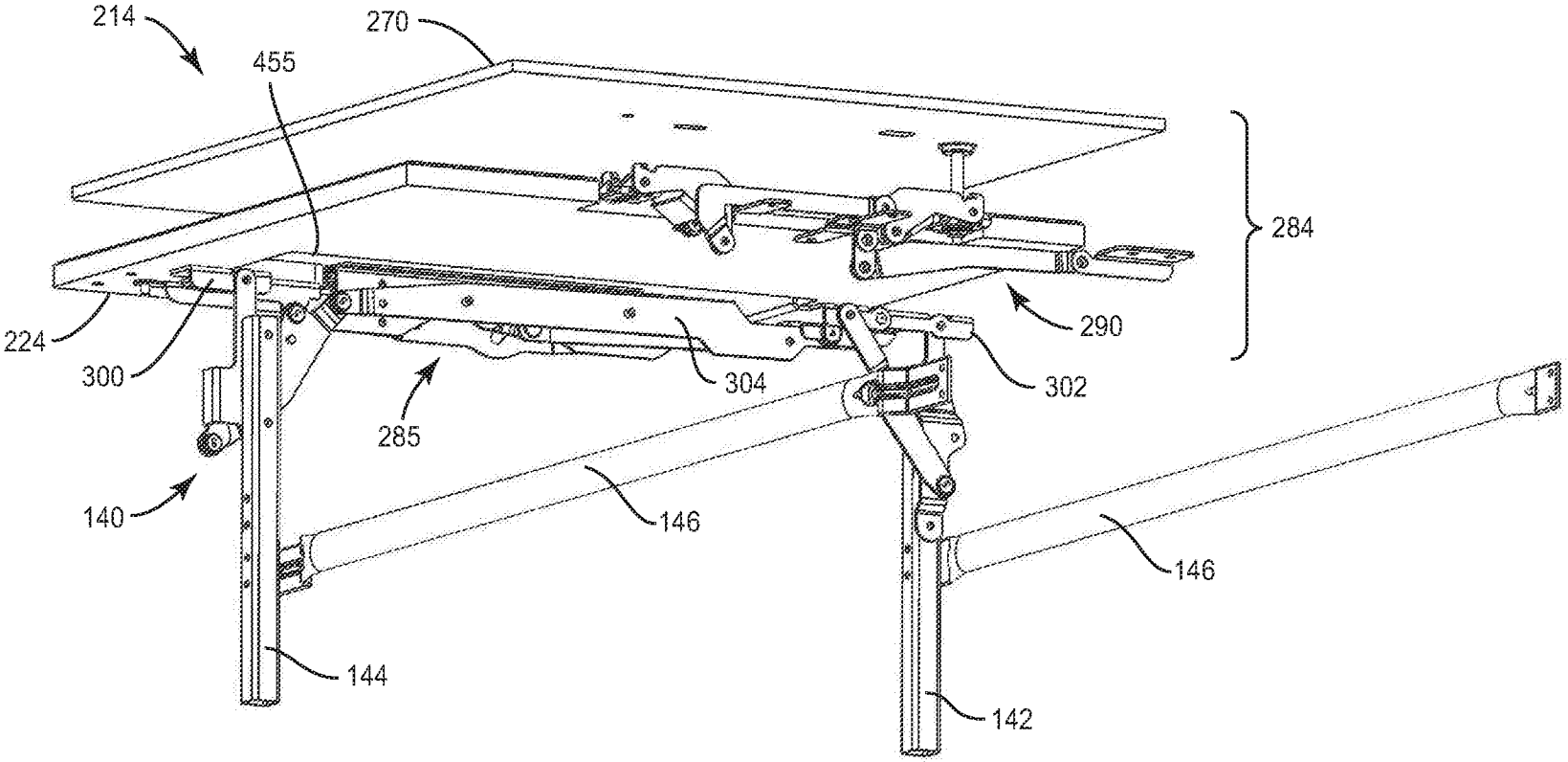
FIG. 11 is a partial interior bottom perspective view of the foot bed section in the bed position.

FIG. 11 shows one first support assembly 285 associated with a leg assembly 140 of the foot bed section 214 in the bed position. Another first support assembly may be associated with a leg assembly on the other side of the foot bed section, the leg assemblies being braced by bars 146 extending therebetween.

Figure 12:
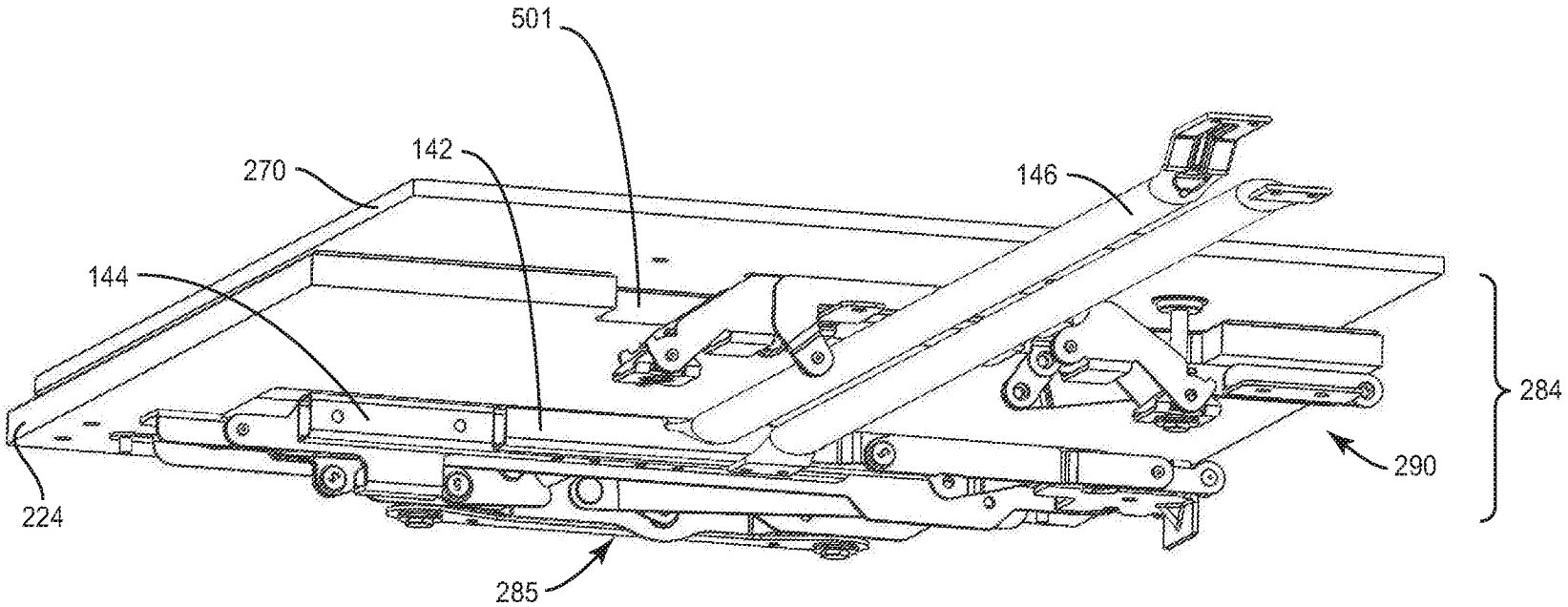
FIG. 12 is a partial interior bottom perspective view of the foot bed section in the seat position.
Figure 13:
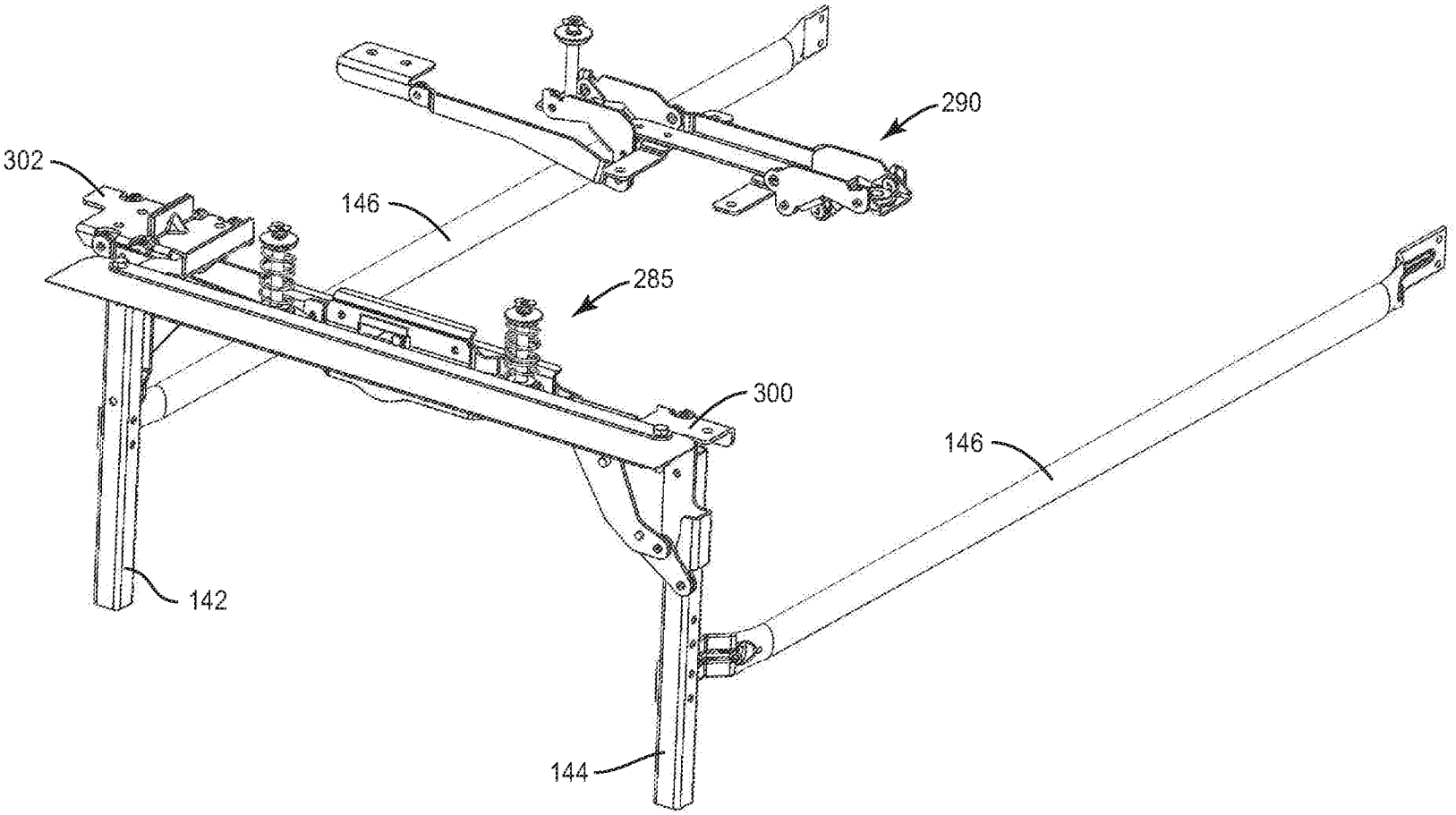
FIG. 13 is a partial exterior top perspective view of the foot bed section in a bed position with the platform and partition omitted.
Figure 14:
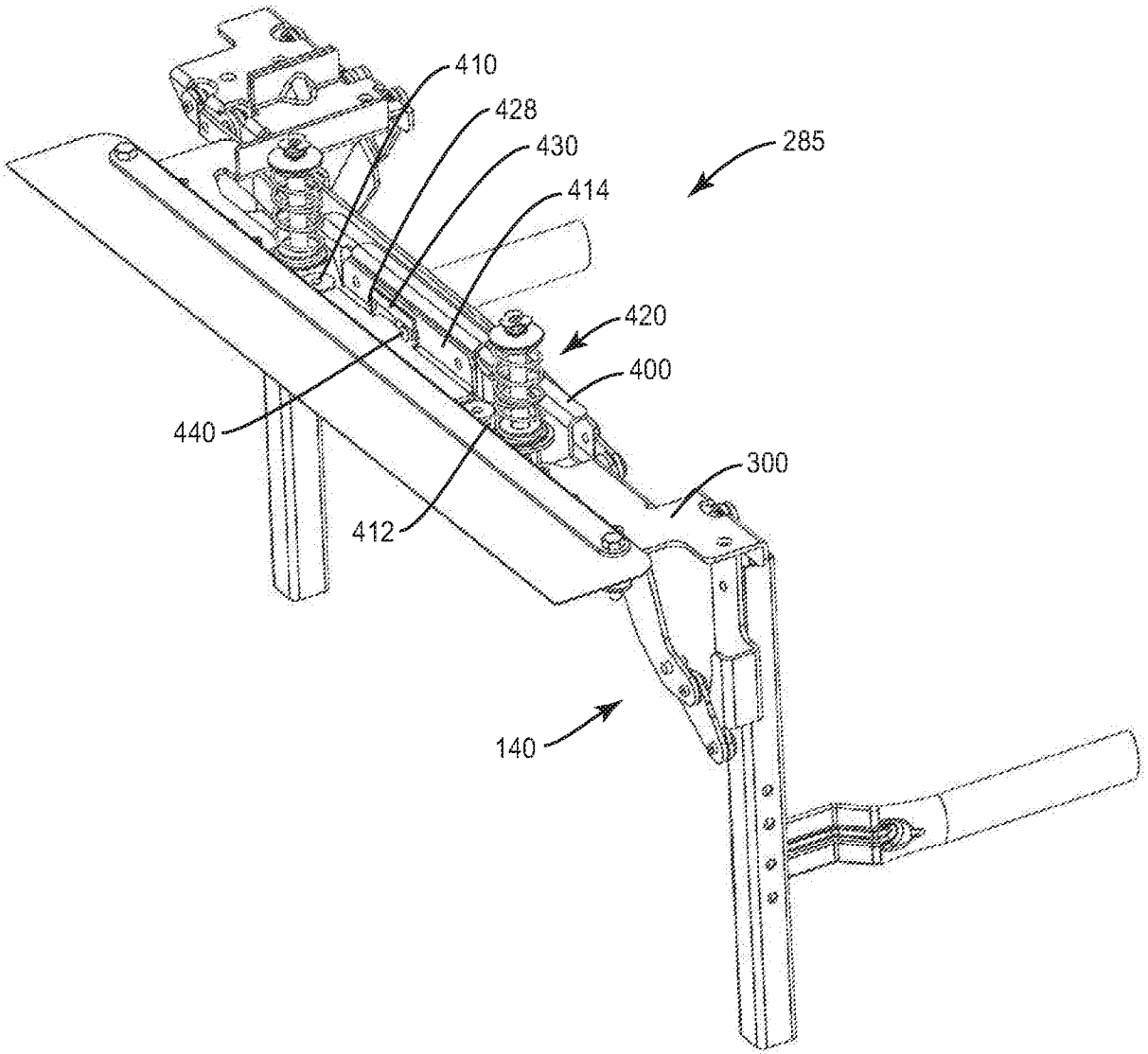
FIG. 14 is an exterior top perspective view of a first support assembly in the bed position.

Foldable legs support the foot section as shown in FIGS. 11-13. The leg assembly 140 includes a foot section bracket 300 to be attached to the foot platform 224 and pivotable relative to a body section bracket 302, which is to be attached to the body platform (not shown). The folding of the body platform relative to the foot platform 224 causes the leg assembly 140 to fold the legs 142, 144 toward one another to positions substantially parallel with the foot platform 224 and partition 270 as shown in FIG. 12.

FIG. 11 depicts a leg-connecting arm 304 that is pivotably attached to the body section bracket 302 and driven as the body section bracket folds relative to the foot section bracket 300 to coordinate the articulation between the folded configuration and the deployed configuration of the legs 142, 144.

With reference to FIGS. 14-17, one example of a first support assembly 285 is now described in more detail. Again, one of ordinary skill in the art will appreciate that the first support assembly 285 may be provided in a left side and right side versions that may require reversing or mirroring of elements within the level of one of ordinary skill in the art. The illustrated embodiment of the first support assembly 285 is suitable for connection to a leg assembly 140, but such connection is not necessarily required and the components may be modified by one of ordinary skill in the art to function without reliance upon a leg assembly.

Figure 15:
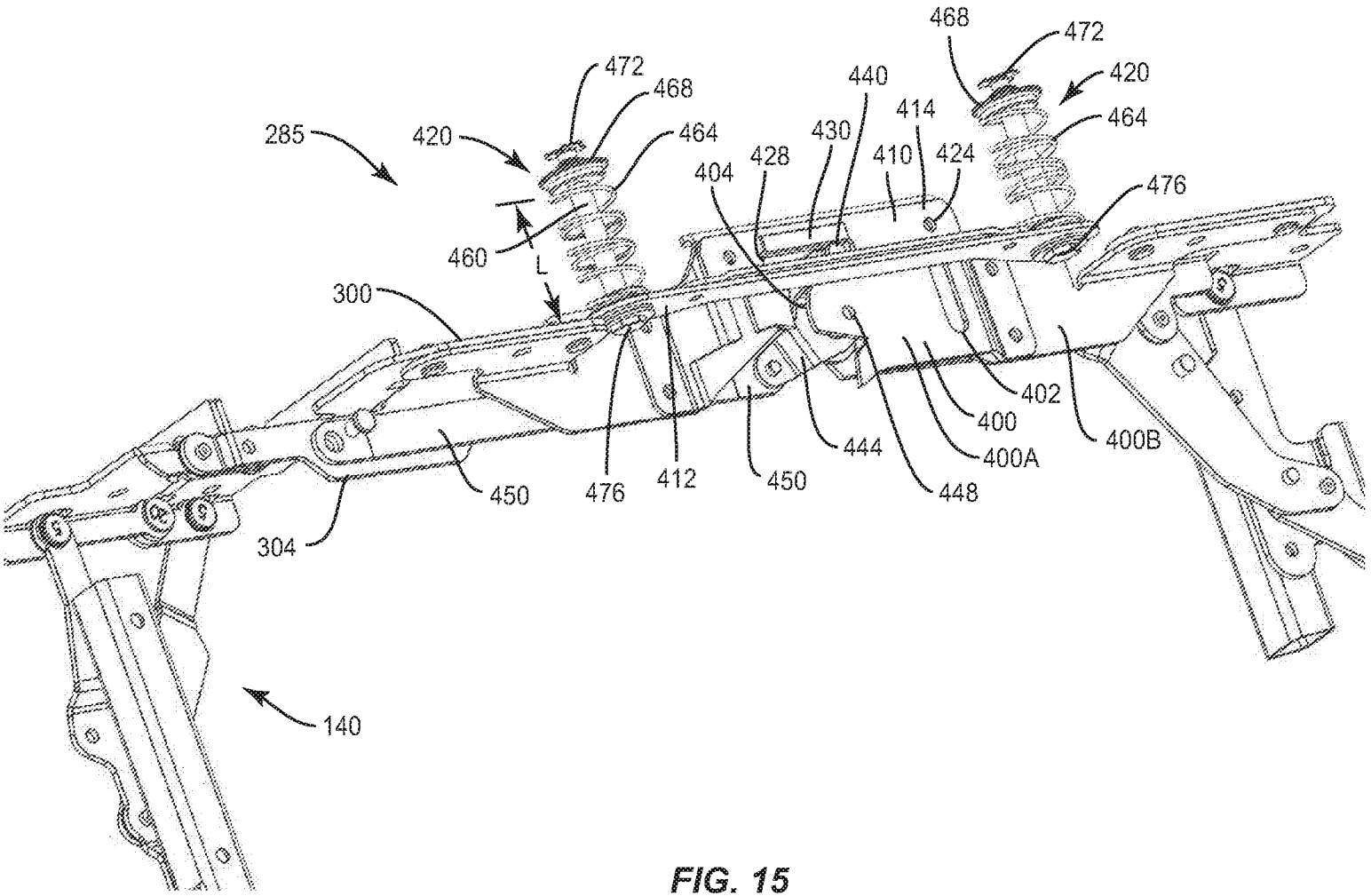
FIG. 15 is an exterior bottom perspective view of the first support assembly in the bed position.
Figure 16:
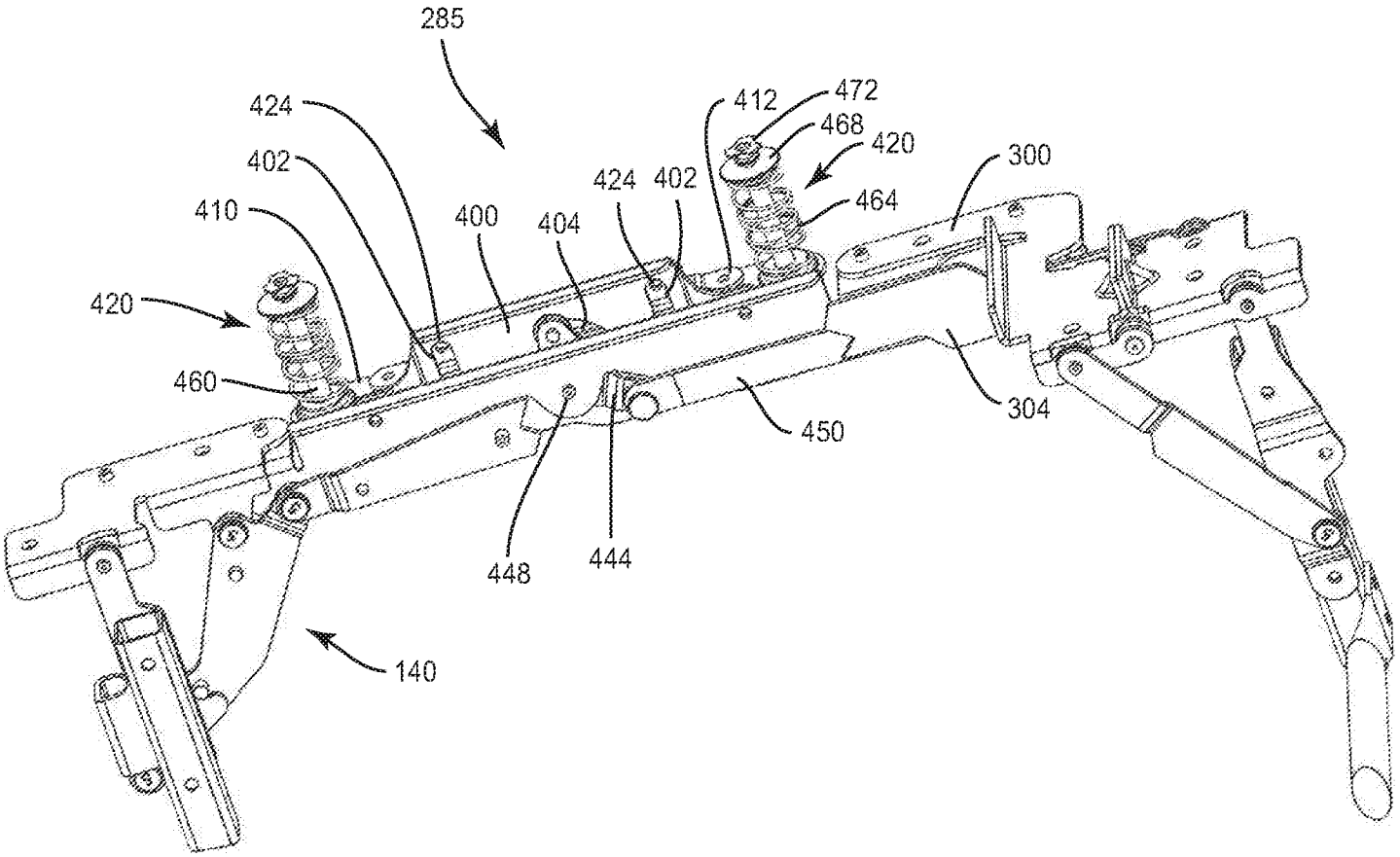
FIG. 16 is an interior top perspective view of the first support assembly in the bed position.

The first support assembly 285 includes a fixed bracket 400. The fixed bracket 400 is fixed relative to the foot platform 224 (FIG. 11). The fixed bracket 400 may be arranged substantially perpendicular to the plane of the foot platform 224. The fixed bracket 400 may be separate from, joined to, or integral with the foot section bracket 300 of the leg assembly 140. The fixed bracket 400 may be a unitary structure or may be comprised of two or more components fixed to one another. As shown in FIG. 15, the fixed bracket 400 comprises a first plate 400A attached to a second plate 400B.

In one embodiment, the fixed bracket 400 includes a pair of guide slots 402 as shown in FIG. 17. The guide slots 402 generally are parallel with one another and arranged perpendicular to the plane of the foot platform. An arched guide slot 404 is arranged in the fixed bracket 400 and is located between the pair of parallel guide slots 402 in the illustrated embodiment. The arched guide slot 404 may be C-shaped and opening to the left or right when in the bed position.

Continuing with FIG. 17, the first support assembly 285 also can include a floating bracket 410. The floating bracket can be generally L-shaped with a horizontal member 412 and a vertical member 414. The terms "horizontal" and "vertical" are relative terms with respect to the first support assembly 285 with the sofa bed is in the bed position. The horizontal member 412 and the vertical member 414 may form a unitary member or may be provided by separate elements fastened or otherwise secured together. The horizontal member 412 supports one or more spacers 420, which support the partition 270 (FIG. 6) at ends thereof opposite the horizontal member. In one embodiment, the spacer 420 is fixed in an orientation perpendicular to the major plane of the partition 270. The vertical member 414 may include guide pins 424 (see FIG. 16) extending therefrom and configured to reside in respective ones of the pair of guide slots 402 in the fixed bracket. The guide pins 424 are configured to travel along the guide slots 402 as the floating bracket 410 raises and lowers relative to the fixed bracket 400, producing linear translation therebetween.

The vertical member 414 may also include a drive slot 428. The drive slot 428 may be positioned along a horizontal direction within the vertical member 414 of the floating bracket 410, perpendicular to the pair of parallel guide slots 402. One or more edges of the drive slot 428 may be coated or otherwise provided with a wear strip 430 to reduce friction and wear as an actuation pin 440 slides within the drive slot 428.

The actuation pin 440 is configured to travel within the drive slot 428 of the floating bracket 410 and the arched guide slot 404 of the fixed bracket 400. The drive slot 428 provides the necessary lateral tolerance for movement of the actuation pin 440 as it travels along the arched path of the arched guide slot 404.

As shown in the cutaway portion of FIG. 15, the actuation pin 440 is attached to one arm of a cam 444 that is pivotably attached to the fixed bracket 400 at a pivot point 448, which forms the center of curvature of the arched guide slot 404. A second arm of the cam 444 is pivotably attached near one end of a drive link 450. An opposite end of the drive link 450 is pivotably attached to the leg-connecting arm 304 of the leg assembly 140.

Thus, the aforementioned components and assemblies permit raising of the partition 270 for use in the bed position. In the illustrated embodiment, as the foot platform hinges relative to the body platform, the leg-connecting arm 304 is displaced, which displaces the drive link 450, which cases the cam 444 to pivot around the pivot point 448. As the cam 444 rotates, the actuation pin 440 is driven along the arched guide slot 404. The contact force between the actuation pin 440 and the drive slot 428 causes the floating bracket 410 to shift relative to the fixed bracket 400 because the weight of the floating bracket 410, the spacers 420, the partition 270, and foot cushion 234, may all be substantially born by the actuation pins of the first support assemblies 285, especially if the second support assembly 290 is not included.

As the floating bracket 410 is lowered relative to the fixed bracket 400, the partition 270 is brought closer to the foot platform 224 (see FIG. 12). In order to accommodate the lowering of the floating bracket 410 relative to the fixed bracket 400, the foot platform 224 may be provided with cut-outs 455 (FIG. 11) and in the seated position, the spacers 420 may pass through the cut-outs with the floating bracket 410 positioned at least partially below the foot platform, and potentially residing at least partially in a cut-out formed in the body platform 222 as shown in FIG. 9.

With reference to FIGS. 15 and 17, in one embodiment, the spacers 420 may be rigid columns that maintain a fixed distance between the horizontal member 412 and the tips of the spacers 420 that are configured to attach to the partition 270 (FIG. 6). In the illustrated embodiment, however, the spacers 420 comprise spring assemblies which are provided to enhance the comfort of the foot bed section 214 (FIG. 6) and further align the characteristics of the body bed section 212 with its thick body cushion 232 with the characteristics of the foot bed section 214 with its thin foot cushion 234.

As shown in FIG. 17, each spring assembly may include at least one rod 460. In one embodiment, the rod 460 can be a threaded retention bolt. A compression spring 464 may surround the rod 460. The compression spring 464 is retained between the partition 270 (FIG. 6) and the horizontal member 412. Optional retainers 468 may be mounted around the rod 460 on one or both ends of the compression spring 464 to preload the spring and allow the spring assemblies to be easier to assemble with the sofa bed 200. Also, a t-nut 472 may be embedded in the partition 270 and the rod 460 can be threaded into the t-nut to attach the spring assembly to the partition 270. The rod 460 passes through an aperture (not shown) in the horizontal member 412. As shown in FIG. 15, upward motion of the rod 460 may be constrained by a head 476 of the rod 460 directly or indirectly against an underside of the horizontal member 412. Washers may be optionally used to distribute forces. Rubber washers may be optionally used to reduce noise.

Thus, once assembled, the compression spring 464 is configured to bias the distal end of the rod 460 away from the horizontal member 412. Because the distal end of the rod 460 is configured to be fixed to the partition 270, the compression spring 464 may bias the partition away from the horizontal member 412. External loading upon the partition 270, however, may provide sufficient external forces to overcome the biasing force of the compression spring 464 and further compress the spring, which results in the partition 270 approaching the horizontal member 412 and the head 476 being forced through the aperture in the horizontal member 412 and down away from the horizontal member. In one example, the external loading is the result of a user resting upon the foot bed section 214. Therefore, the compression spring 464 is compressed from its initial length L (FIG. 15) as a result of external loads, and when externally loaded, may coincidentally result in a shorting of the distance between the partition 270 and the foot platform 224. The primary contracting of the distance between the partition 270 and the foot platform 224, however, as the sofa bed 200 is converted to the seat position, neither causes nor requires shortening of the initial length of the compression spring 464. In other words, transitioning the sofa bed 200 from the bed position to the seat position does not compress the compression spring 464.

The compression spring 464 may function like a box spring supporting the foot cushion 234 as shown in FIG. 6. In order to properly position the foot cushion 234 in the bed position, the initial length L (FIG. 15) of the compression spring 464 plus the thickness T2 (FIG. 6) of the foot cushion may be approximately equal to the thickness T1 of the body cushion 232. Preferably, a user sitting on the sofa bed 200 on both the body bed section 212 and the foot bed section 214 may not be able to distinguish the degree of firmness or comfort provided by the foot bed section versus the body bed section even though they are constructed differently. As used herein, firmness is measured by determining the force necessary to compress a portion of a bed section 3" from the apparent thickness T (FIG. 5) thereof. The compression force is applied to the bed section at a corner thereof but offset 3" from each edge at the corresponding corner. The bed section is compressed by applying a force spread over a 5" square compression surface.

In addition to firmness as defined above, another method to determine whether distinct bed sections have similar performance characteristics may be to perform the standard ASTM F1566 (version 2014) test on each bed section. Another known measure used to rate cushions, and therefore compare performance of separate bed sections, is indention force deflection (IFD). The IFD can be determined according to ASTM standard D3574 (version 2017).

To adjust the performance of the foot bed section 114 to be equivalent to the body bed section 112, various aspects of the construction of the foot bed section may be varied, including the thickness T2 of the foot cushion 234, the material of the foot cushion, the thickness/rigidity of the partition 270, and the stiffness of the compression springs 464. Preferably, designers first should select the spring constant of the compression springs 464 sufficiently high to avoid having the springs become fully compressed or "bottoming out" when a user rests on the foot bed section 114. In one embodiment, a spring constant of approximately 14 lbs./in was found suitable. As such, the compression springs 464 contribute to the perceived softness of the foot bed section 214 relative to the body bed section 212. Therefore, even though the foot cushion 234 is thinner than the body cushion 232, the material of the foot cushion may be selected to be firmer or have a higher IFD rating than the material used for the body cushion.

In another example, the foot bed section 214 and the body bed section 212 had substantially similar firmness using a 5" thick foam body cushion 232, and a 3" thick foam foot cushion 234 of the same material and a partition 270 made from ⅜" inch thick plywood supported by six compression springs 464 each having a spring constant of approximately 14 lbs./in.

FIGS. 18-20 show detailed views of the second support assembly 290. Including one or more second support assembly 290 may be particularly useful for supporting larger queen or king sized beds. For at least the reason of packaging with the bars 146 of the leg assemblies 140 in the seat position (see FIG. 12), the second support assembly 290 may be a distinct construction from the at least one first support assembly 285, though their general function is much the same. The second support assembly may be configured so that the bars 146 are able to fold into a position closely adjacent to the foot platform 224.

Continuing with FIG. 18, the second support assembly 290 may include a mounting bracket 500 configured to mount to the foot platform 224 (FIG. 11). In one embodiment, the mounting bracket 500 is positioned within a cutout 501 (FIG. 12) in the foot platform 224. A pair of mounting arms 502 may be configured such that a connecting span 504 of the mounting bracket 500 is positioned within the thickness of the foot platform 224.

A body section attachment 510 may be pivotably mounted to a drive linkage 512. The drive linkage 512 may be pivotably mounted to a first end of a drive cam 514. The drive cam 514 is pivotably joined to the mounting bracket 500. A floating support 516 may be pivotably attached to a second end of the drive cam 514. The drive cam 514 may be rotationally fixed to a follower cam 518 which also pivots relative to the mounting bracket 500. As will be appreciated by one of ordinary skill in the art, the follower cam 518 may be substantially identical to the drive cam 514. Further, because the cams 514, 518 are fixed to one another, they also may be considered a single part. Transmission links 522, 524 may be pivotably attached to the follower cam 518 and drive cam 514 respectively to transmit motion to a second set of cams 526 pivotably mounted to the mounting bracket 500 and pivotably mounted to a second floating support 530. While two transmission links 522, 524 are shown in FIG. 18, use of a single transmission link may be sufficient. The pair of transmission links 522, 524 may be preferred however to balance the loads on the components of the second support assembly 290. Each floating support 516, 530 includes a slot 535 (FIG. 19) that receives a portion of a spacer 540. Each spacer 540 is configured to be rigidly attached the partition 270 at one end and movably attached to the floating support 516, 530 at the opposite end. As illustrated, the spacers 540 may comprise spring assemblies substantially similar to those described above.

For the illustrated embodiment of the second support assembly 290, folding of the body bed section 212 relative to the foot bed section 214 displaces the drive linkage 512, which cases the drive cam 514 to rotate, thereby adjusting the relative position of the floating support 516 relative to the mounting bracket 500 (i.e. the foot platform 224). The pivot connection between the floating support 516 and the drive cam 514 allows the floating support 516 to remain substantially parallel with the partition 270. The slots 535 allow the spacers 540 to move relative to the floating supports 516, 530, which is necessary because the spacers are fixed in a position relative to the partition 270.

As understood by one of ordinary skill in the art, the transmission links 522, 524 convey rotational motion of the drive cam 514 into subsequent rotation of the second set of cams 526, thereby also adjusting the second floating support 530. Therefore, much like the first support assembly 285, the second support assembly 290 is configured to adjust the relative distance between the partition 270 and the foot platform 224 without additional compression of the optional compression springs used to optionally form a portion of the spacers 540.

With reference back to FIG. 8, the sofa bed 200 may be constructed with a modular approach to simplify assembly. One step may include obtaining a foot platform 224. Another step may include obtaining a first module. The first module may include, the foot cushion 234 supported on the partition 270. The first module may also include the foam pieces 283 and a pair of tuck panels 278, all wrapped with ticking 274 that is joined to the tuck panels. The bolts 280 may extend from the first module. The first module may be installed onto the foot platform 224 by aligning the bolts with corresponding holes in the foot platform and securing the bolts with nuts.

A second module may comprise the combination of the leg assembly 140 and the first support assemblies 285 as partially shown in FIG. 11. The leg assembly 140 may be initially attached to the foot platform 224. Then, to facilitate the expansion and contraction function of the foot bed section 214, each rod 460 of each first support assembly 285 may be threaded into a corresponding t-nut 472 (FIG. 17) previously embedded or otherwise fixed in the partition 270.

The embodiments of the invention described above are intended to be merely exemplary; numerous variations and modifications will be apparent to those skilled in the art. All such variations and modifications are intended to be within the scope of the present invention as defined in any appended claims.

The invention claimed is:

1. Furniture convertible between a seat position and a bed position, the furniture comprising:

a first bed section comprising a first platform supporting a first cushion; and a second bed section comprising a second platform, a second cushion, and a partition disposed between the second platform and the second cushion;

wherein the first platform is configured to pivot relative to the second platform, wherein the first cushion has a first thickness measured perpendicular to the first platform, wherein the second cushion has a second thickness measured perpendicular to the second platform, wherein the first thickness is greater than the second thickness, wherein, when the furniture is in the bed position:

a top surface of the first cushion is substantially coplanar with a top surface of the second cushion, and the partition is spaced from the second platform by a first distance, the partition supported by at least one spring, and wherein, in the seat position of the furniture, the distance between the partition and the second platform is less than the first distance.

2. The furniture of claim 1, wherein the at least one spring is a compression spring and a length of the at least one spring in the seat position is substantially equal to the length of the at least one spring in the bed position when no external force is applied to the second cushion.

3. The furniture of claim 2, wherein, in the seat position, the at least one spring extends through the second platform.

4. The furniture of claim 1, wherein a firmness of the first bed section is substantially equivalent to a firmness of the second bed section.

5. The furniture of claim 1, wherein, when the furniture is in the bed position, the first platform is substantially coplanar with the second platform.

6. Furniture convertible between a seat position and a bed position, the furniture comprising:

a first bed section comprising a first platform supporting a first cushion;

a second bed section comprising a second platform, a second cushion, and a partition disposed between the second platform and the second cushion;

ticking for covering the second cushion and hiding the partition; and a tuck panel attached to the second platform, the tuck panel configured to position the ticking relative to a top surface of the second platform, wherein the first platform is configured to pivot relative to the second platform, wherein the first cushion has a first thickness measured perpendicular to the first platform, wherein the second cushion has a second thickness measured perpendicular to the second platform, wherein the first thickness is greater than the second thickness, wherein, when the furniture is in the bed position:

a top surface of the first cushion is substantially coplanar with a top surface of the second cushion, and the partition is spaced from the second platform by a first distance, and wherein, in the seat position of the furniture, the distance between the partition and the second platform is less than the first distance, wherein the ticking is applied from a top surface of the second platform around the top surface of the second cushion, wherein, when the furniture is in the bed position, the first bed section appears substantially identical to the second bed section, wherein the tuck panel is configured to flex relative to the top surface of the second platform to accommodate a portion of a bed sheet between the tuck panel and the top surface of the second platform.

7. The furniture of claim 6, wherein compressible foam is positioned between the top surface of the second platform and the partition to substantially fill a gap therebetween along at least one edge of the second platform.

8. Furniture convertible between a seat position and a bed position, the furniture comprising:

a first bed section comprising a first platform supporting a first cushion;

a second bed section comprising a second platform, a second cushion, and a partition disposed between the second platform and the second cushion, the second bed section configured to fold relative to the first bed section; and a third bed section comprising a third platform supporting a third cushion, the third bed section being movable relative to the first and second bed sections, wherein the first cushion has a first thickness measured perpendicular to the first platform, wherein the second cushion has a second thickness measured perpendicular to the second platform, wherein the first thickness is greater than the second thickness, wherein, when the furniture is in the bed position:

a top surface of the first cushion is substantially coplanar with and adjacent to a top surface of the second cushion and a top surface of the third cushion is substantially coplanar with and adjacent to the top surface of the second cushion, and the partition is spaced from the second platform by a first distance, the partition supported by at least one spring, wherein, in the seat position of the furniture, the distance between the partition and the second platform is less than the first distance.

9. The furniture of claim 8, wherein the spring is configured to contract when subject to external forces, and wherein the spring is configured to maintain a length thereof as the furniture is converted from the bed position to the seat position.

10. The furniture of claim 9, wherein a firmness of the first bed section is substantially equivalent to a firmness of the second bed section.

11. The furniture of claim 8, further comprising at least one leg configured to fold relative to the second platform for supporting the second platform above a floor in the bed position, the at least one leg having a folded position substantially parallel with the second platform in the seat position and an unfolded position substantially perpendicular to the second platform in the bed position.

12. The furniture of claim 8, wherein, when the furniture is in the bed position, the first platform is substantially coplanar with the second platform, and the third platform is inclined relative to the second platform.

13. Furniture convertible between a seat position and a bed position, the furniture comprising:

a first bed section comprising a first platform supporting a first cushion;

a second bed section comprising a second platform, a second cushion, and a partition disposed between the second platform and the second cushion, the second bed section configured to fold relative to the first bed section;

a third bed section comprising a third platform supporting a third cushion, the third bed section being movable relative to the first and second bed sections;

a ticking for covering the second cushion and hiding the partition; and a tuck panel attached to the second platform, the tuck panel configured to position the ticking relative to a top surface of the second platform, wherein the first cushion has a first thickness measured perpendicular to the first platform, wherein the second cushion has a second thickness measured perpendicular to the second platform, wherein the first thickness is greater than the second thickness, wherein, when the furniture is in the bed position:

a top surface of the first cushion is substantially coplanar with and adjacent to a top surface of the second cushion and a top surface of the third cushion is substantially coplanar with and adjacent to the top surface of the second cushion, and the partition is spaced from the second platform by a first distance, wherein, in the seat position of the furniture, the distance between the partition and the second platform is less than the first distance, wherein the ticking is applied from a top surface of the second platform around the top surface of the second cushion, wherein, when the furniture is in the bed position, the first bed section appears substantially identical to the second bed section, wherein the tuck panel is configured to flex relative to the top surface of the second platform to accommodate a portion of a bed sheet between the tuck panel and the top surface of the second platform.

14. The furniture of claim 13, wherein compressible foam is positioned between the top surface of the second platform and the partition to substantially fill a gap therebetween along at least one edge of the second platform.

15. Furniture convertible between a seat position and a bed position, the furniture comprising:

a first bed section comprising a first platform supporting a first cushion; and a second bed section comprising a second platform, a second cushion, at least one spring supporting the second cushion, and a partition disposed between the second platform and the second cushion, the partition being supported by the at least one spring;

wherein the first cushion has a first thickness measured perpendicular to the first platform, wherein the second cushion has a second thickness measured perpendicular to the second platform, wherein the first thickness is greater than the second thickness, wherein a firmness of the first bed section is substantially equivalent to a firmness of the second bed section.

16. The furniture of claim 15, wherein the first bed section is configured to pivot relative to the second bed section, wherein, when the furniture is in the bed position:

a top surface of the first cushion is substantially coplanar with a top surface of the second cushion, and the partition is spaced from the second platform by a first distance, wherein, in the seat position of the furniture, the distance between the partition and the second platform is less than the first distance.

17. The furniture of claim 16, wherein a length of the at least one spring in the seat position is substantially equal to the length of the at least one spring in the bed position when no external force is applied to the second cushion.

18. The furniture of claim 16, further comprising ticking for covering the second cushion and hiding the partition; and a tuck panel attached to the second platform, the tuck panel configured to position the ticking relative to a top surface of the second platform, wherein the ticking is applied from a top surface of the second platform around the top surface of the second cushion, wherein, when the furniture is in the bed position, the first bed section appears substantially identical to the second bed section, wherein the tuck panel is configured to flex relative to the top surface of the second platform to accommodate a portion of a bed sheet between the tuck panel and the top surface of the second platform.

19. The furniture of claim 18, wherein compressible foam is positioned between the top surface of the second platform and the partition to substantially fill a gap therebetween along at least one edge of the second platform.

20. Furniture convertible between a seat position and a bed position, the furniture comprising:

a first bed section comprising a first platform supporting a first cushion, the first cushion extending from the first platform to a top surface of the first cushion to define an apparent thickness of the first bed section; and a second bed section comprising a second platform, a partition, and a second cushion, the second bed section being pivotable relative to the first bed section, the partition supported by at least one spring between the second cushion and the second platform, the second bed section having an apparent thickness defined between the platform and a top surface of the second cushion, the second cushion having a thickness less than a thickness of the first cushion, wherein, when the furniture is in the bed position:

the first platform is substantially coplanar with the second platform, and the top surface of the first cushion is substantially coplanar with the top surface of the second cushion, such that the apparent thickness of the first and second bed sections are substantially equal to one another; and wherein, when the furniture is in the seat position, the first and second bed sections are stacked relative to one another within a space having a height that is less than two times the apparent thicknesses in the bed position, the apparent thickness of the second bed section being less than the apparent thickness of the first bed section.

21. The furniture of claim 20, wherein the at least one spring is configured to position the partition relative to the second platform and to adjust the distance between the partition and the second platform, wherein the spring is configured to contract when subject to external forces, and wherein the spring is configured to maintain a length thereof as the bed section is converted from the bed position to the seat position.

* * * * *